US008079412B2

(12) United States Patent
Short

(10) Patent No.: US 8,079,412 B2
(45) Date of Patent: Dec. 20, 2011

(54) METHOD AND APPARATUS FOR MITIGATING ENVIRONMENTAL IMPACT DUE TO FLUID LEAKS

(75) Inventor: Robert Short, Douglas, WY (US)

(73) Assignee: Satellite Systems & Solutions, Inc., Douglas, WY (US)

( * ) Notice: Subject to any disclaimer, the term of this patent is extended or adjusted under 35 U.S.C. 154(b) by 85 days.

(21) Appl. No.: 12/397,235

(22) Filed: Mar. 3, 2009

(65) Prior Publication Data

US 2010/0059217 A1 Mar. 11, 2010

Related U.S. Application Data

(60) Provisional application No. 61/033,269, filed on Mar. 3, 2008.

(51) Int. Cl.
*E21B 19/00* (2006.01)

(52) U.S. Cl. ..... 166/81.1; 402/52

(58) Field of Classification Search ..... 166/81.1, 166/75.13; 175/209; 405/52; 220/484, 4.02, 220/4.03, 212
See application file for complete search history.

(56) References Cited

U.S. PATENT DOCUMENTS

| | | | |
|---|---|---|---|
| 5,655,561 | A | 8/1997 | Wendel |
| 5,967,171 | A | 10/1999 | Dwyer |
| 6,025,788 | A | 2/2000 | Diduck |
| 6,057,770 | A | 5/2000 | Justesen |
| 6,147,613 | A | 11/2000 | Doumit |
| 6,526,807 | B1 | 3/2003 | Doumit |
| 6,639,517 | B1 | 10/2003 | Chapman |
| 6,683,535 | B1 | 1/2004 | Utke |
| 6,731,215 | B2 | 5/2004 | Harms |
| 6,826,948 | B1 | 12/2004 | Bhatti |
| 6,987,458 | B1 | 1/2006 | Limmer |
| 6,995,676 | B2 | 2/2006 | Amacher |
| 7,126,486 | B2 | 10/2006 | Kroll |
| 7,142,107 | B2 | 11/2006 | Kates |
| 7,218,237 | B2 | 5/2007 | Kates |
| 7,230,528 | B2 | 6/2007 | Kates |
| 7,292,155 | B2 | 11/2007 | Vokey |
| 2003/0066340 | A1 | 4/2003 | Hassenflug |
| 2006/0191323 | A1 | 8/2006 | Garabedian |

FOREIGN PATENT DOCUMENTS

| | | |
|---|---|---|
| JP | 62095438 | 3/1999 |

OTHER PUBLICATIONS

U.S. Appl. No. 61/033,269, filed Mar. 3, 2008.

*Primary Examiner* — Daniel P Stephenson
*Assistant Examiner* — Kipp Wallace
(74) *Attorney, Agent, or Firm* — Santangelo Law Offices, P.C.

(57) ABSTRACT

Embodiments of the inventive technology may provide a leaked fluid detection and response system in one aspect, and in another aspect, an environmental enclosure for at least a component of such leaked fluid detection system. Various embodiments of the leaked fluid detection and response system may provide wireless communication of detected leaks and a PLC that automates response and provides information regarding the presence of a leak. Enclosures may, in various embodiments, comprehensively surround enclosed components, thermally insulate enclosed components, include a leaked fluid capture basin, be aerodynamically streamlined, and/or be vermin-tight.

19 Claims, 20 Drawing Sheets

| | | |
|---|---|---|
| $R_T$ | | $S_{A,PLC}$ |
| $R_L$ | | |
| $R_A$ | $R_D$ | 9 |

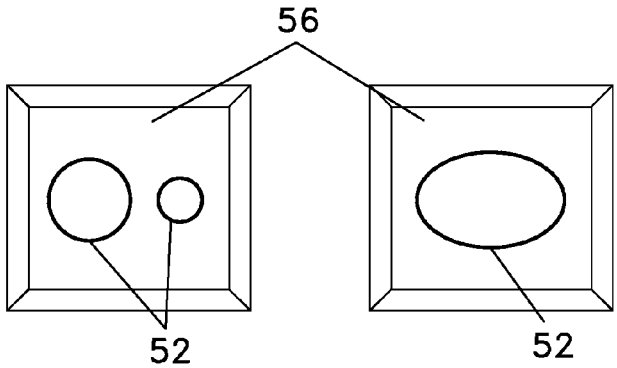
Fig. 20A
Fig. 20B
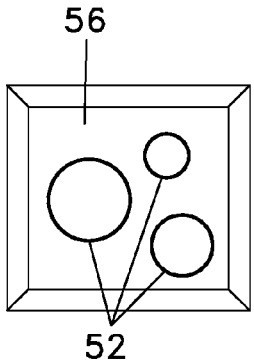
Fig. 20C
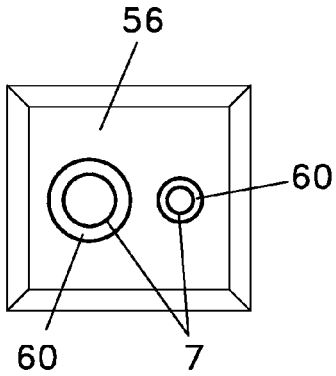
Fig. 20D
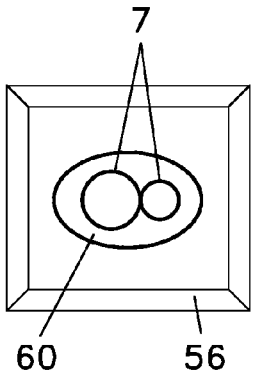
Fig. 20E
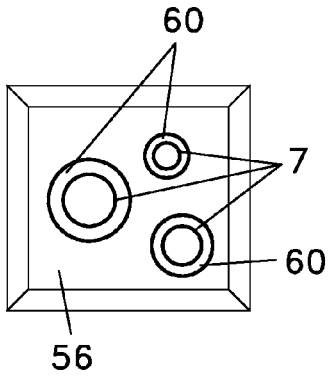
Fig. 20F
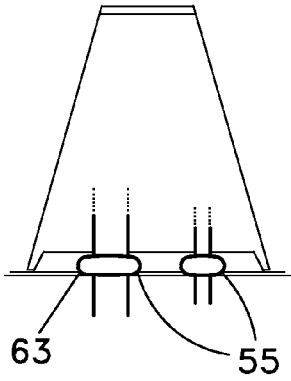
Fig. 20G
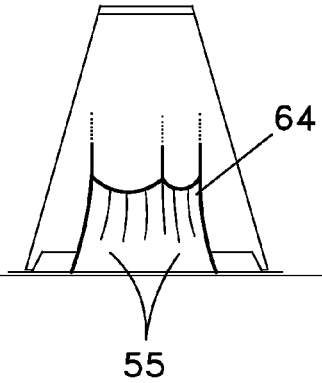
Fig. 20H
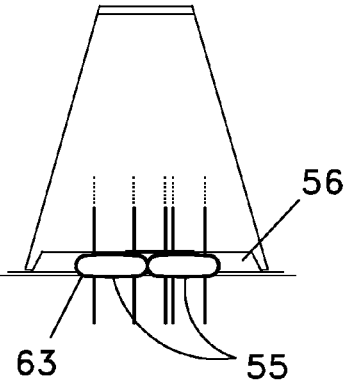
Fig. 20I

METHOD AND APPARATUS FOR MITIGATING ENVIRONMENTAL IMPACT DUE TO FLUID LEAKS

CROSS-REFERENCE TO RELATED APPLICATIONS

This US non-provisional patent application claims priority to U.S. provisional patent application 61/033,269, filed Mar. 3, 2008, said provisional application incorporated herein in its entirety.

BACKGROUND OF THE INVENTION

The inventive technology, in particular embodiments, provides an apparatus and method for protecting the natural world/surrounding environment from leaks in the well-based, underground resource recovery (e.g., U3O8 in-situ leach mining) environment which might lead to undesired consequences such as contamination of the surface water for wildlife, contamination of plants, as well as loss of production and costly clean up, etc.

Mining operations involving wells (whether in-situ leach mining, domestic water recovery, oil recovery, natural gas recovery, or mineral mining generally, as but a few examples) necessarily involve conduit conveyance of fluid (whether gaseous or liquid) under pressure. Often, particularly at an interface of earth and atmosphere (e.g., above ground, atmosphere-exposed, even where the ground has been lowered) where thermal stresses and thermal cycling may be extreme (e.g., temperature extrema may be more than 30 degs. C apart in particular locations), fluid leaks may develop. Such leaks, of course, if not detected and resolved in some fashion, may contaminate the immediate environment and compromise mining operations. Indeed, governmental regulations may soon require mining companies mitigate environmental impact due to such fluid leaks by mandating leak detection and/or leaked fluid capture. Particular embodiments of the inventive technology may seek to mitigate deleterious environmental impact due to such leaks, whether by providing an automated detection and notification system, and/or providing environmental enclosures for wellheads that may attenuate thermal cycling and reduce the risk of leaks while also improving the reliability of leak detection systems.

BRIEF SUMMARY OF THE INVENTION

Particular embodiments of the inventive technology seek to mitigate negative environmental impact by providing a leak detection, leaked fluid capture, and leak notification system. Additional aspects of the inventive technology relate to an environmental enclosure that may enhance functional integrity of leak detection systems enclosed thereby, in addition to lessening risk of leaks by providing thermal insulation and protection from the external environment.

Although certainly not the only application of the inventive technology, U3O8 mining is well suited for application of the embodiments of the inventive technology. First, a single U3O8 in-situ mining operation may involve hundreds and thousands of injection and extraction wells. These locations are distributed across many square miles. The vast number of injection/extraction points makes daily inspection for leaks nearly impossible. The inventive, technology, in particular embodiments, allows for a constant monitoring of each location either via wired or wireless modality.

Embodiments of the inventive technology seek to provide an alternative to the only environmental enclosures for wellheads that are available, as such conventional apparatus are deficient in at least one respect. Either they are not at all aerodynamically streamlined (and suffer damage, are blown away, or induce wind scour), do not have a lower floor (e.g., a catch basin) that, with sealed openings, prevents vermin from digging under enclosure sides and entering the enclosure (at which time they may "teethe" and destroy enclosed components), are not thermally insulative (and fail to mitigate the thermal cycling that is a major cause of leaks), and/or do not have any sort of capture basin that would serve to capture leaked fluid and mitigate environmental impact. Embodiments of the inventive technology seek to resolve one or more of such problems.

BRIEF DESCRIPTION OF THE DRAWINGS

FIG. 5A shows a wireless point-to-multipoint communication system while

FIGS. 20A-C show aerial views of three embodiments of the leaked fluid capture basin with at least one opening. FIGS. 20D-F show aerial views of such three embodiments, with conduit(s) passing through the openings. FIGS. 20G-I show side views of enclosures having the basins of FIGS. 20A-C, showing two of the many possible sealer types.

DETAILED DESCRIPTION OF THE INVENTION

Figure 1:
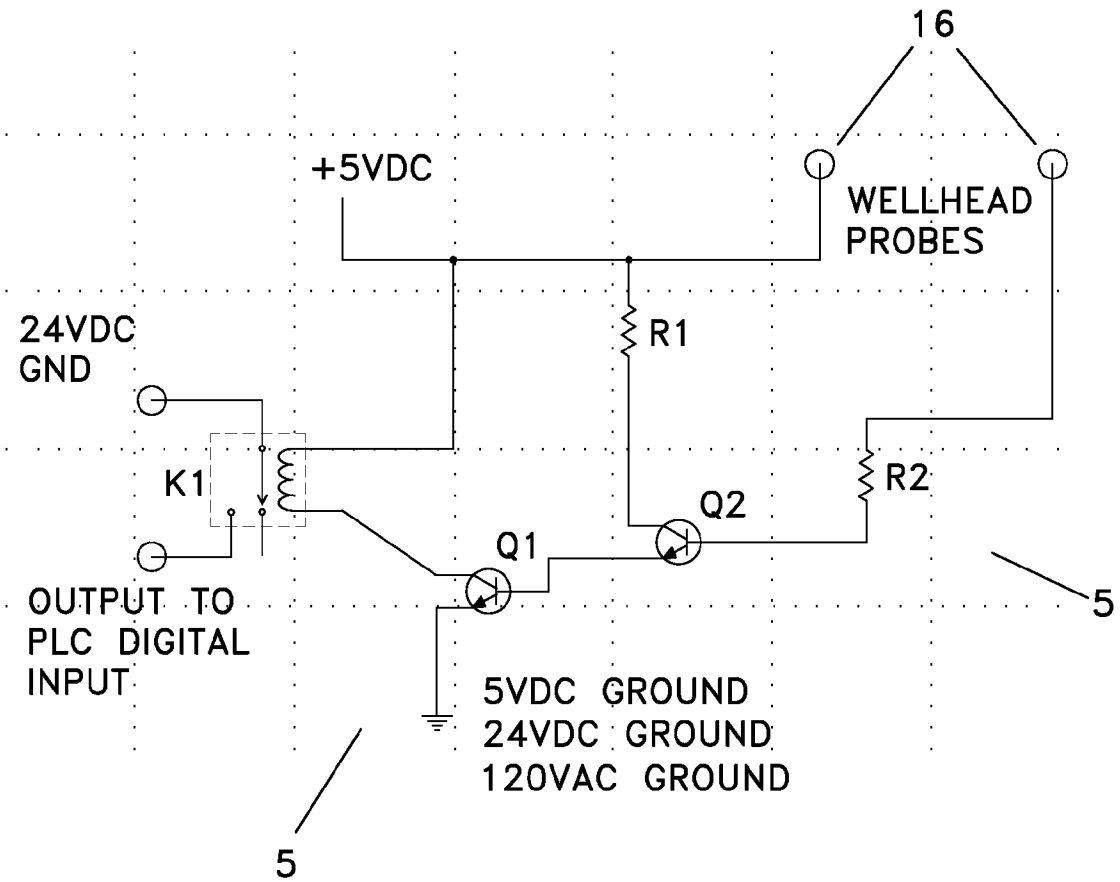
FIG. 1 shows an exemplary leak detector (hardwire version).
Figure 2:
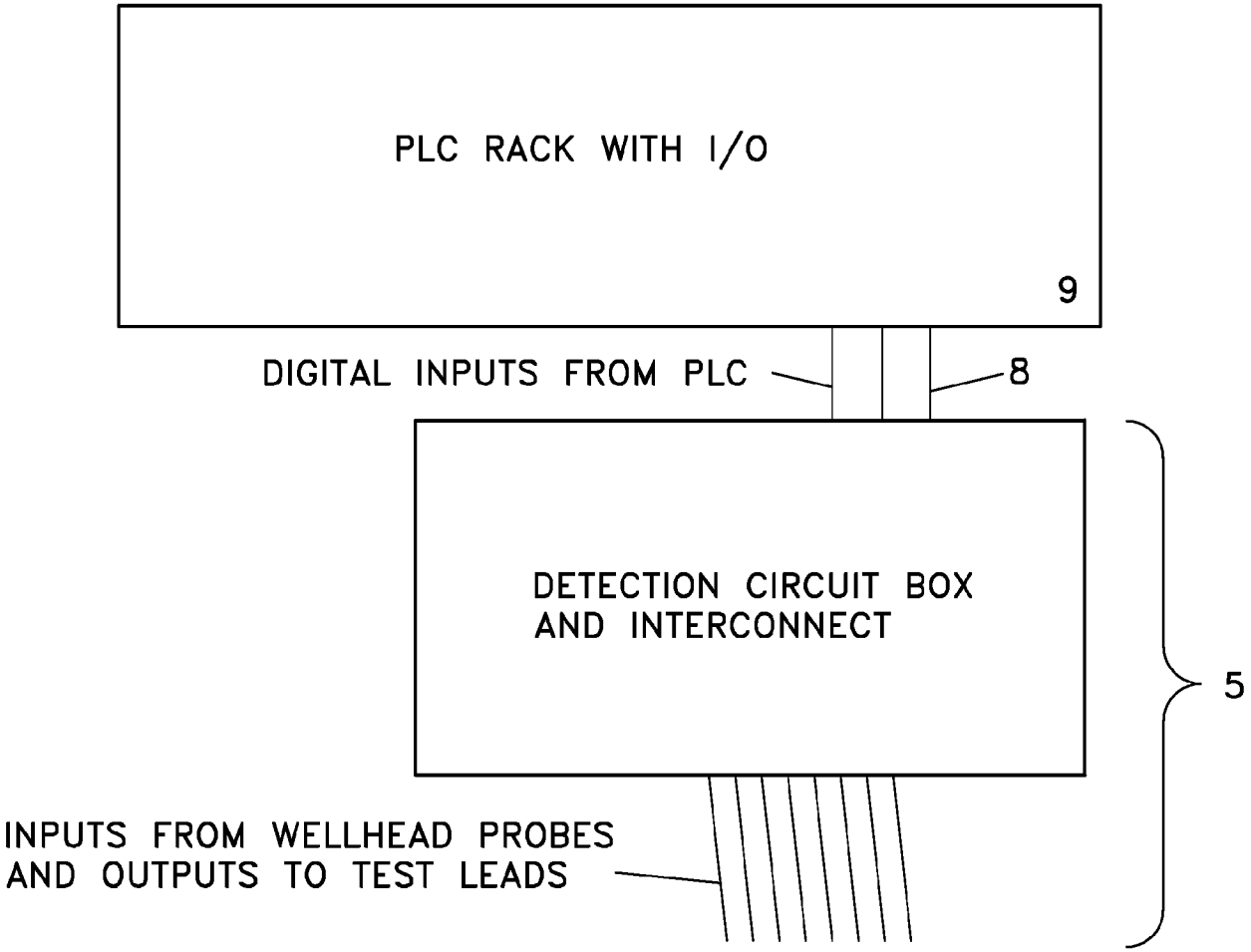
FIG. 2 shows a circuit block diagram for an embodiment having a detector, communication system and PLC.
Figure 3:
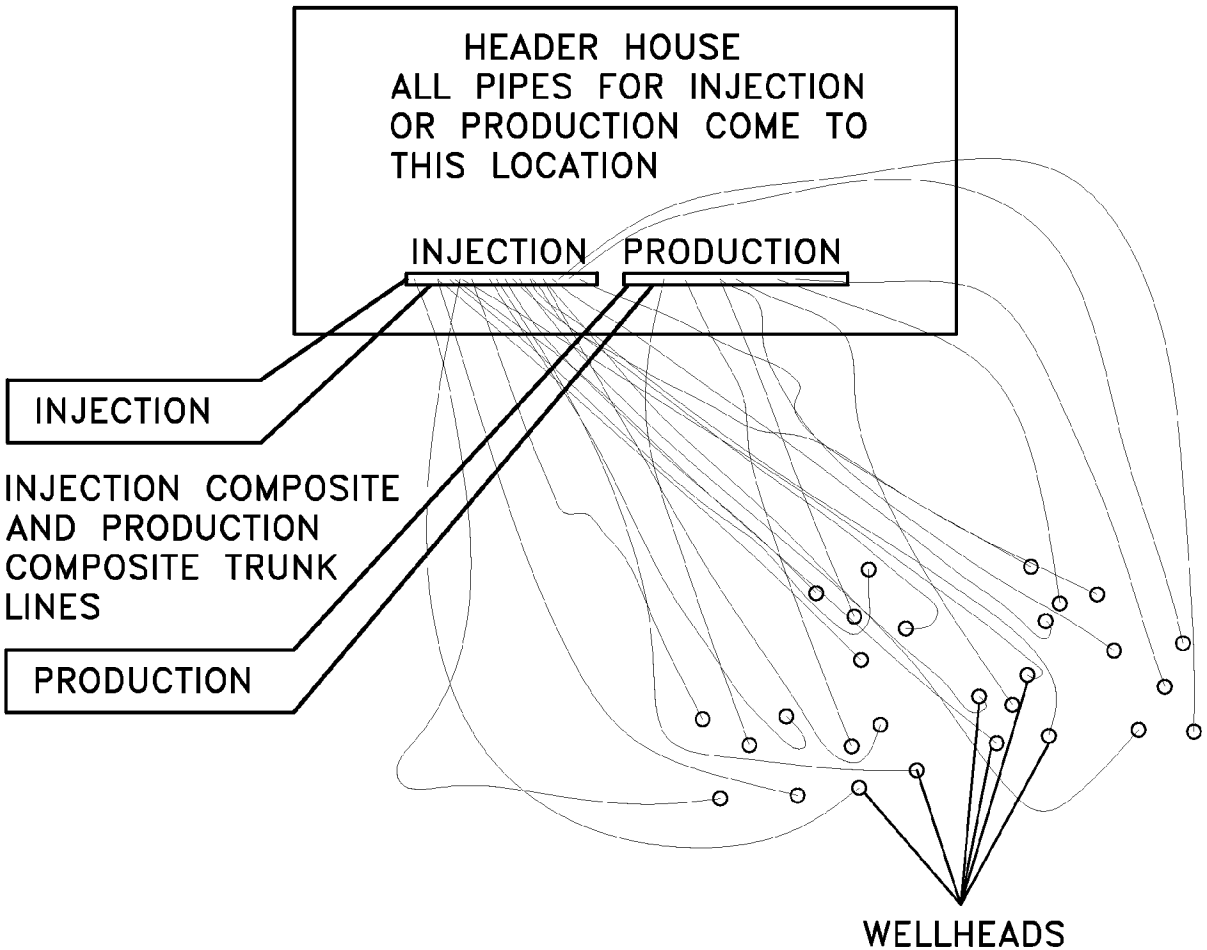
FIG. 3 shows a wellfield sketch.
Figure 4:
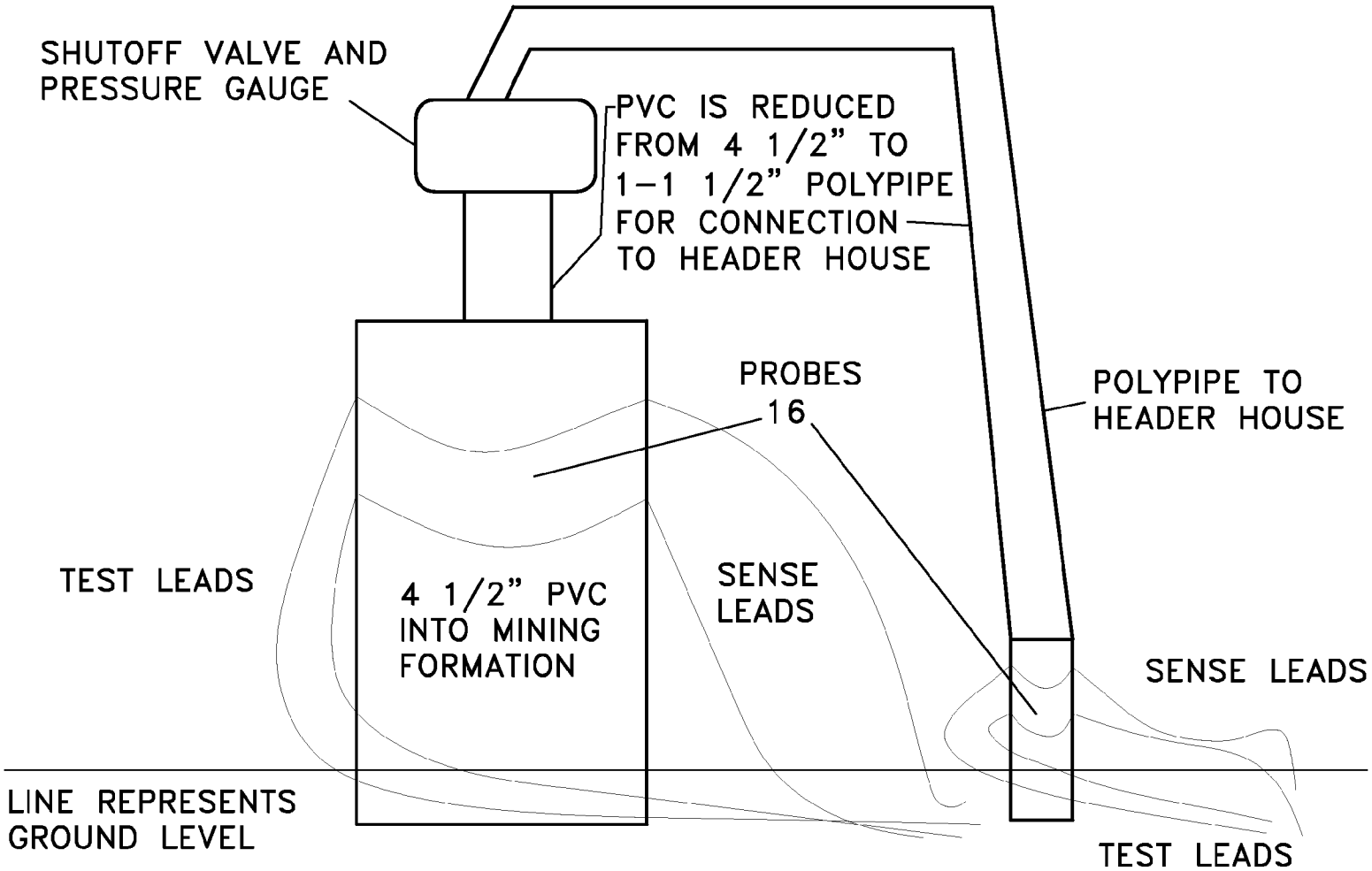
FIG. 4 shows a wellhead sketch.

As mentioned earlier, the present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

At least one embodiment of the inventive technology may be described as an above-ground, well fluid leak detection and response apparatus comprising: at least one well fluid leak detector (5) (which of course may be a circuit and include detector circuitry) established (e.g., electrically connected, powered and located) to generate information regarding the presence of a leak (6) of a well fluid from a well fluid conduit (7); a communication system (8) configured (e.g., electrically powered and properly set up) to convey the information; a programmable logic controller (9) configured to act according to the information; a response system (10) coordinated with the programmable logic controller to automatically act in the event of detection of the well fluid leak; and at least one power supply (11) that powers the at least one well fluid leak detector, the communication system, the programmable logic controller and the response system.

The applications of any technology disclosed herein may be broad. Indeed, the technology may be used to detect leaks from well fluids such as barren lixiviant, lixiviant, in-situ mining fluid, in-situ leach mining fluid, in-situ recovery mining fluid, in-situ uranium mining fluid, slurry mining fluid, slurry uranium mining fluid, disposal well fluid, uranium mining disposal well fluid, production well fluid, uranium mining production well fluid, injection well fluid, uranium mining injection well fluid, water, hot mineralized water, hydrocarbon mining fluid, hydrocarbon leach mining fluid, oil well fluid, oil, natural gas mining fluid, and natural gas. Also suggestive of the breadth of application of the inventive technology is the fact that the well fluid conduit can be a well head conduit, valve station conduit, bell hole conduit, or a transition hole conduit. In the US, an important application may be in-situ U3O8 mining; in Canada, it may be slurry uranium mining (where leaks may occur at the disposal wells).

In particular embodiments, the inventive technology relates to an apparatus (in certain embodiments, a computerized system of sorts) that is a modular (in that it may digital or analog-based) U3O8 in-situ leach mining (or more broadly, barren lixiviant mining) well fluid leak detection and response apparatus in which well fluid leak detectors integrate into PLC's (e.g., via a communication system such as hardwired digital input or analog input, or via RS232, 422, 485, Ethernet (as but a few wireless examples)) using, e.g., point-to-multipoint radio systems or mesh radio systems or other communication methodology.

In at least one embodiment, the system may include a well fluid leak detector powered by a power supply(ies), and may include four circular probes located at the point of the injection or extraction of the mining composite. In certain embodiments, the system is designed so that at each well fluid conduit at which a leak is to be detected and stopped, two probes are attached and spaced two to four inches apart, one above the other, above ground but below the bottom mechanical joint, to a 4½" PVC pipe (well casing) which extends down into the mining area and two probes are attached in similar fashion below the bottom mechanical joint to the ~1" Polypipe which returns to the header house (as in the case of a production well in the U3O8 in-situ leach mining environment). These probes may be attached to conductors which, in a wired communication system embodiment, are routed back to the header house and then integrated into the PLC. An additional conductor may be connected to each probe at the well fluid conduit (e.g., at the wellhead) as part of a functionality verification system that may automatically test (perhaps repeatedly throughout the day) whether the system is functioning properly. Information regarding the presence of a leak is conveyed via a wired or wireless communication system (8) to a PLC (9) (e.g., it may be plumbed into a PLC digital input card). When leaked well fluid flows down across the two probes, information regarding the presence of a leak may be generated when the leaked fluid causes a continuity between the probes (part of a type of a well fluid leak detector) which in turn activates a circuit relay and, via a communication system, passes information regarding the presence of a leak (e.g., 24VDC) to the PLC input card. The PLC, upon receiving such information (or a modified (e.g., conditioned or organized) variant thereof), activates a set of software commands that trigger a response system to broadcast a message (e.g., an instant message) via a human notification system (12). Such message may be sent via network connection to a remote monitoring location as well as the local location. The response system, in implementing the human notification system, may also activate another visual notifier and/or audible notifier of the leak, in addition to indicating the location of the leak. The response system may be contingent on customer needs—in some cases a visual indication of problem may be sufficient, while in other cases an immediate system shutdown may be warranted. This may be all, or in larger part, accomplished though software programming of the PLC (with, of course, help from the response system).

As mentioned, particular embodiments of the inventive technology use well fluid leak detectors (typically, a known fluid leak detector, such as, but not limited to a conductive probe pair (16), a float type (17) fluid leak detector (e.g., established in a leaked fluid capture basin), conductive mesh or tape (18) type detector, or a gaseous sniffer). In embodiments with probe pairs, the probe pair may be established substantially on the outer surface of the well fluid conduit; in others, the probe pair may be established so that it hangs into at least one leaked fluid capture basin established below the at least one probe pair. In particular embodiments of the inventive technology, the detectors (e.g., one such circuit for each point at which a leak is to be detected) can be deployed in very high numbers (indeed, there may be a detector at each wellhead).

The system may be designed to include many detectors communicative with one or more PLC devices to provide a method for instigating a change in operation (e.g., shutdown of flow to a particular conduit or particular mining unit header house) and provide for an alarm and communication of the condition via digital signage messaging, messaging on control room computer screens at remote location(s), via viewing panel at the header house location and via network, either wired or wireless network, to operator computers or even cell phones on the field patrol or at the desktop. As mentioned, the programmable logic controller may be configured to act according to the information (even where such information is received by a receiver of the communication system and then input into the PLC, the PLC acts according to such information). Indeed, all that is meant by configured to act according to such information is that a change in such information can cause the PLC to act in a changed manner (e.g., when the change in information indicates a leak, the PLC may activate a notification system). The response system may be coordinated with the programmable logic controller to automatically act in the event of detection of the well fluid leak in that the PLC may be programmed to activate the response system (and any notification or automatic shutdown system that may be a part of it) in the event of a leak. Even where it appears that the response system or the communication system are components of the PLC (indeed, some PC's may be purchased with wireless receivers), they may be considered distinct system components.

Figures 10A, 10B:
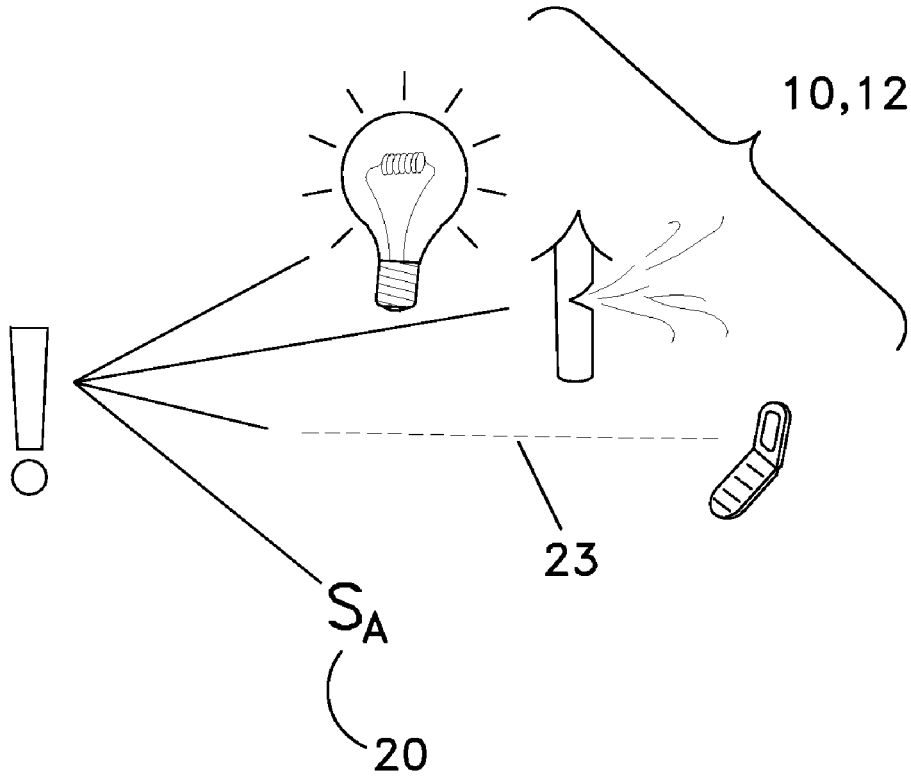
FIG. 10A shows a block diagram of the PLC.
FIG. 10B shows a block diagram of the response system.
Figure 11:
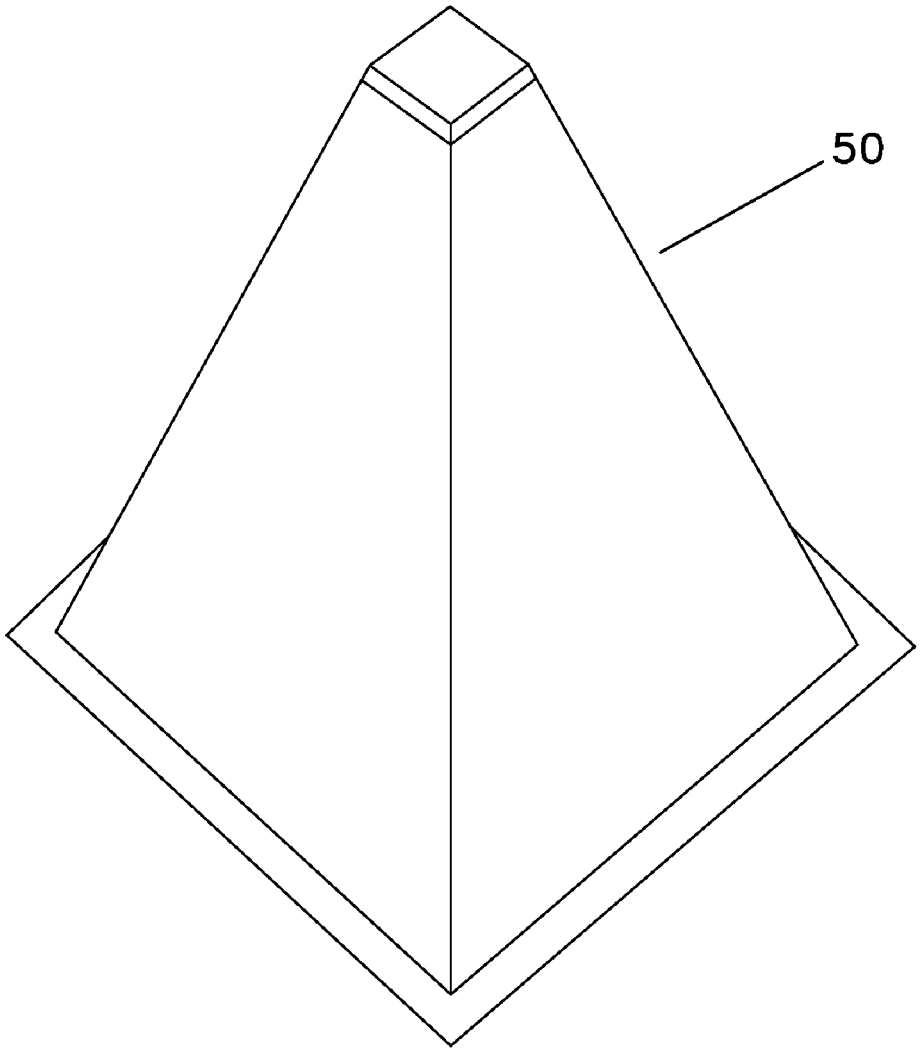
FIG. 11 shows an embodiment of the environmental enclosure.
Figure 12:
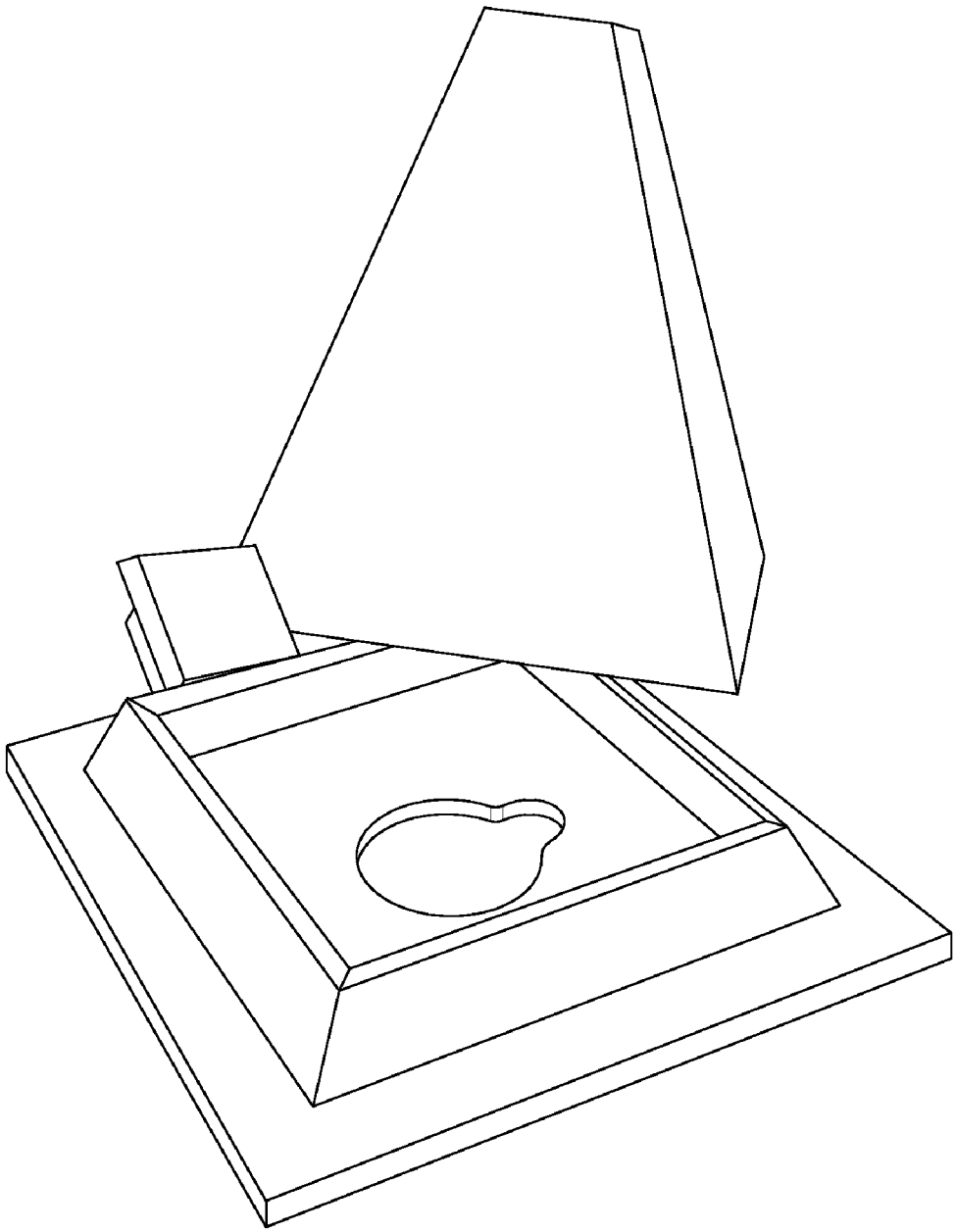
FIG. 12 shows a photograph of an embodiment of the environmental enclosure.
Figure 13:
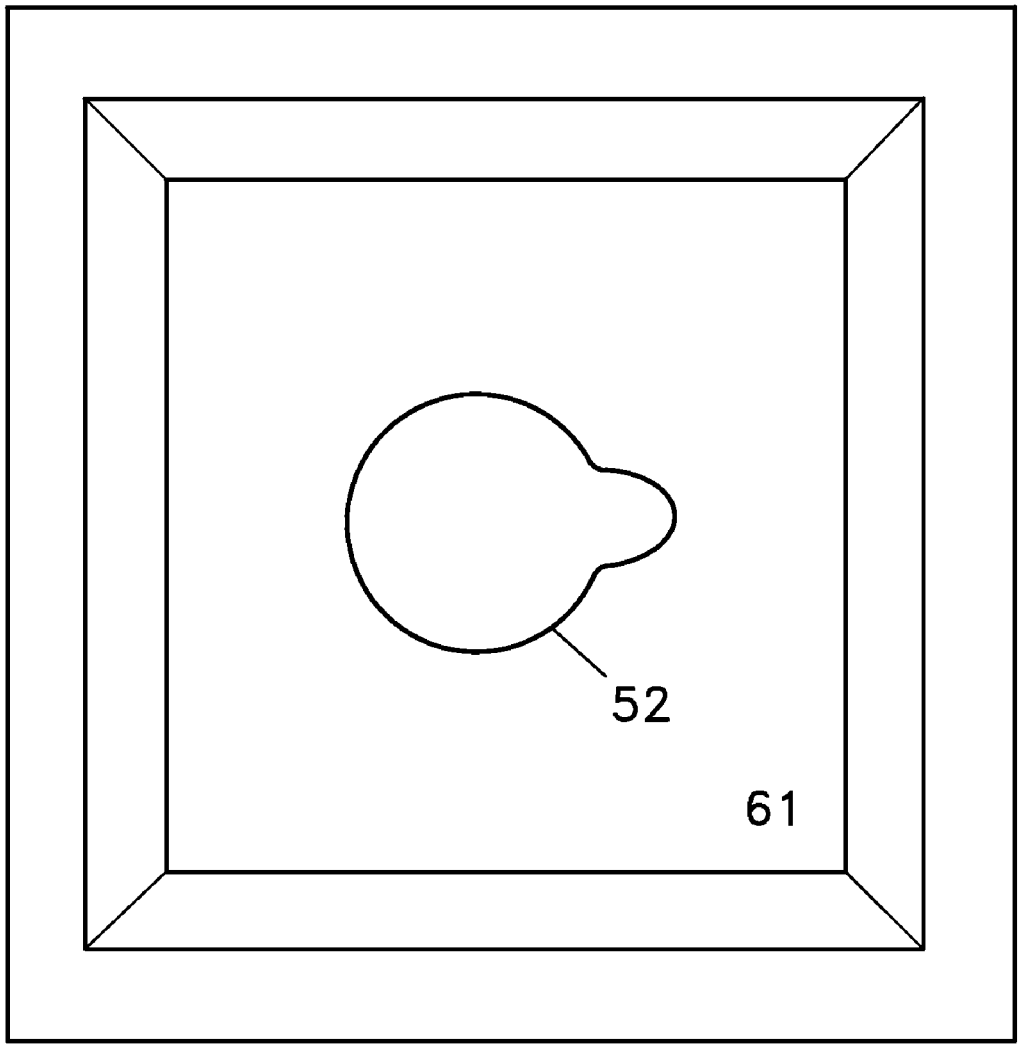
FIG. 13 shows a top view of the leaked fluid capture basin, and an opening through which conduit may pass.
Figure 14:
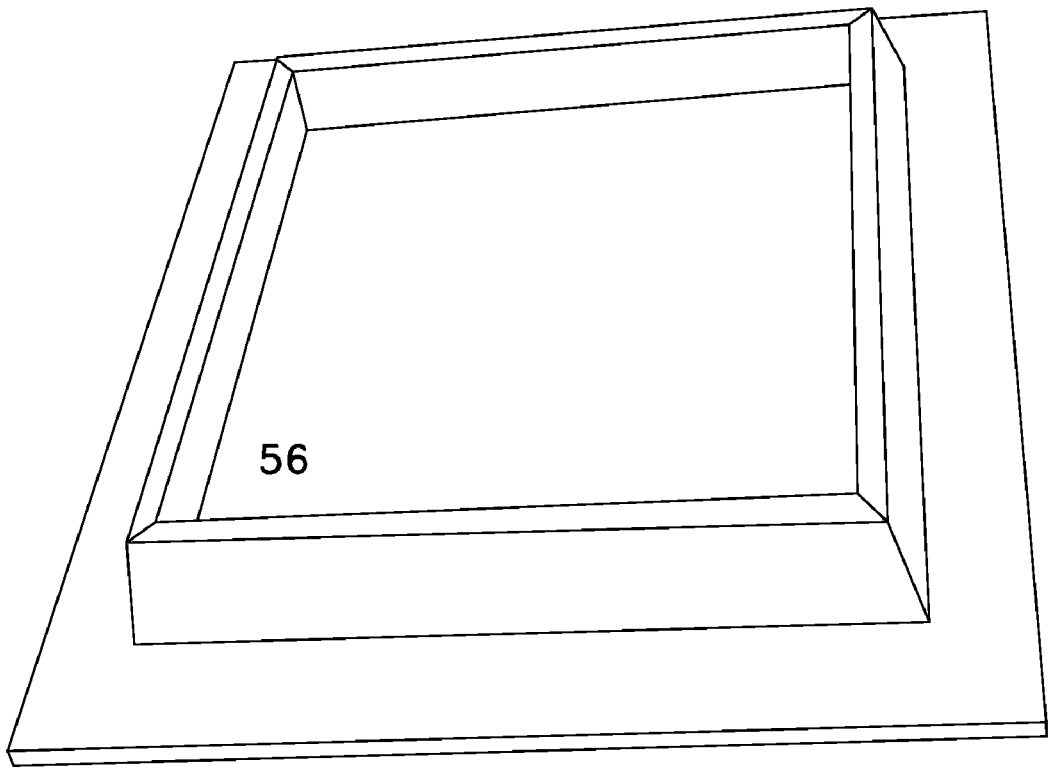
FIG. 14 shows a perspective view of the leaked fluid capture basin before an opening for conduit is cut in it.
Figure 15:
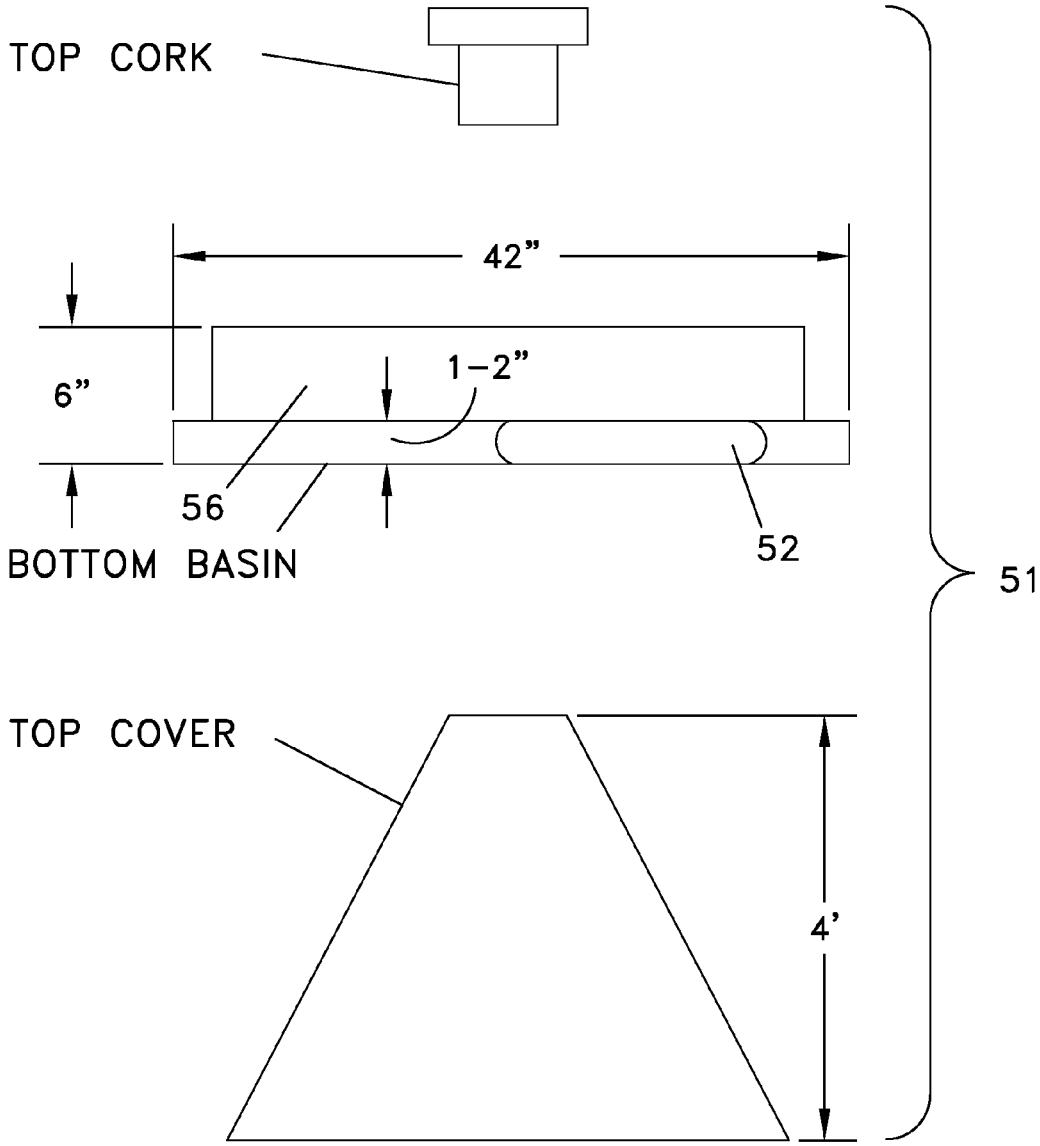
FIG. 15 shows components of the environmental enclosure, including merely exemplary dimensions as may be found in one embodiment. The outer horizontal flange of the basin may be, in this embodiment, from 3-4 inches wide.
Figure 16:
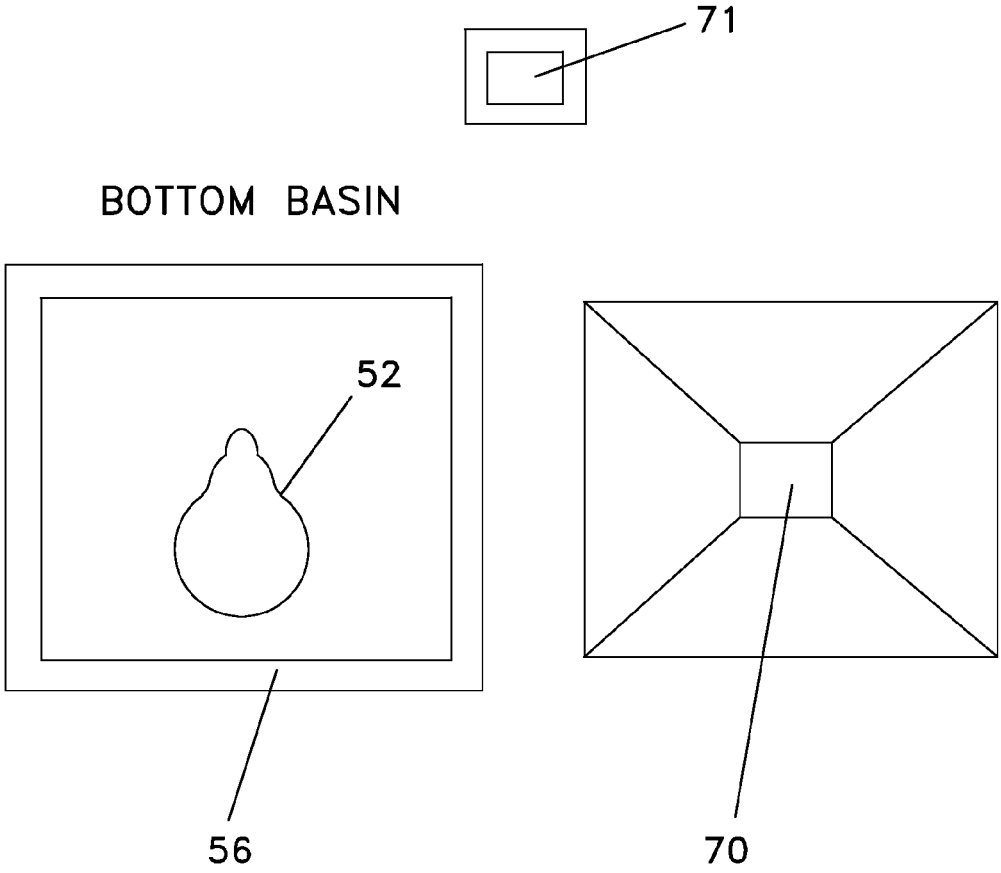
FIG. 16 shows a top view of components of the environmental enclosure, as they may appear in one embodiment of the inventive technology.
Figure 17:
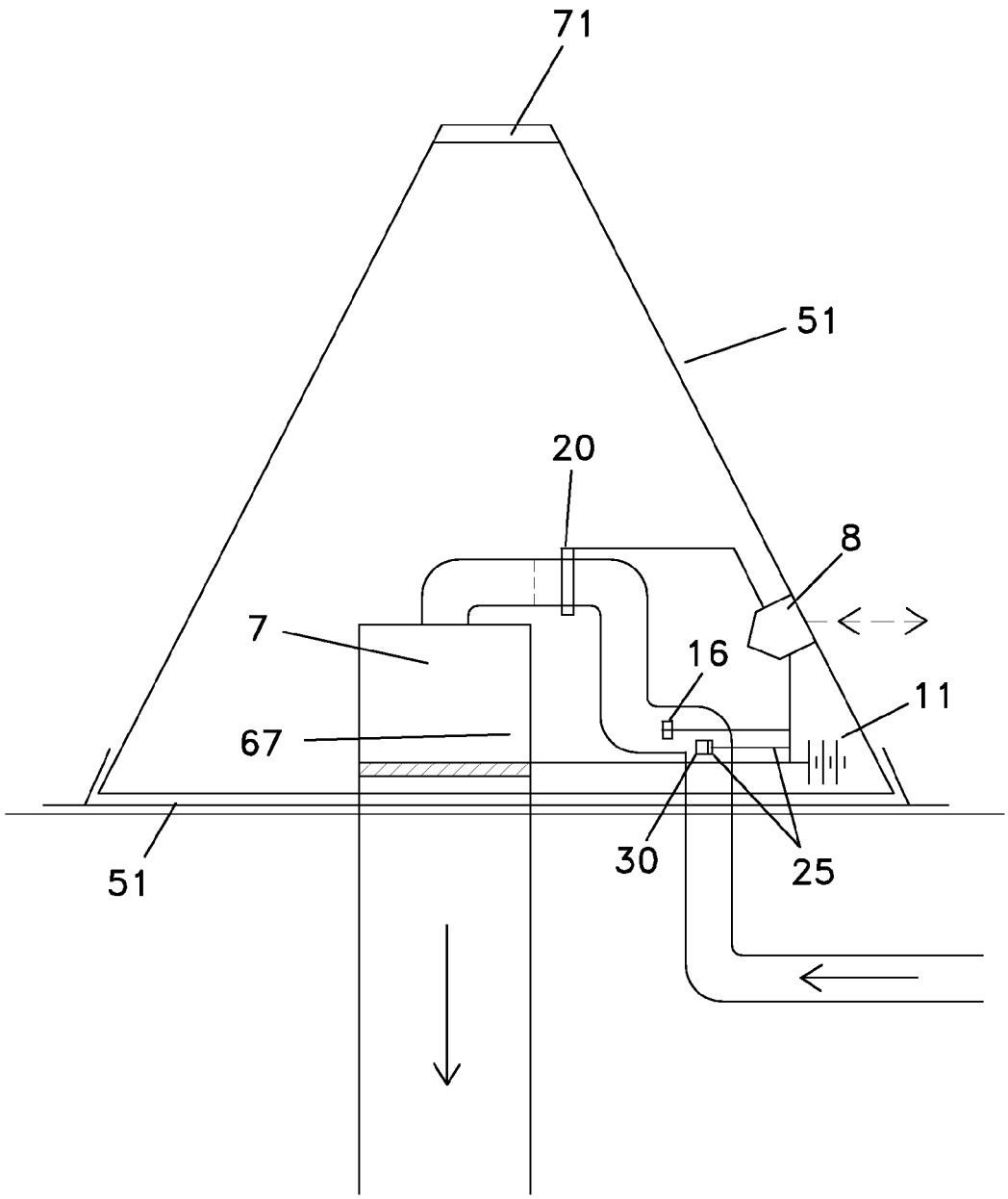
FIG. 17 shows a cut-away, cross-sectional view of an embodiment of the inventive technology.
Figure 18:
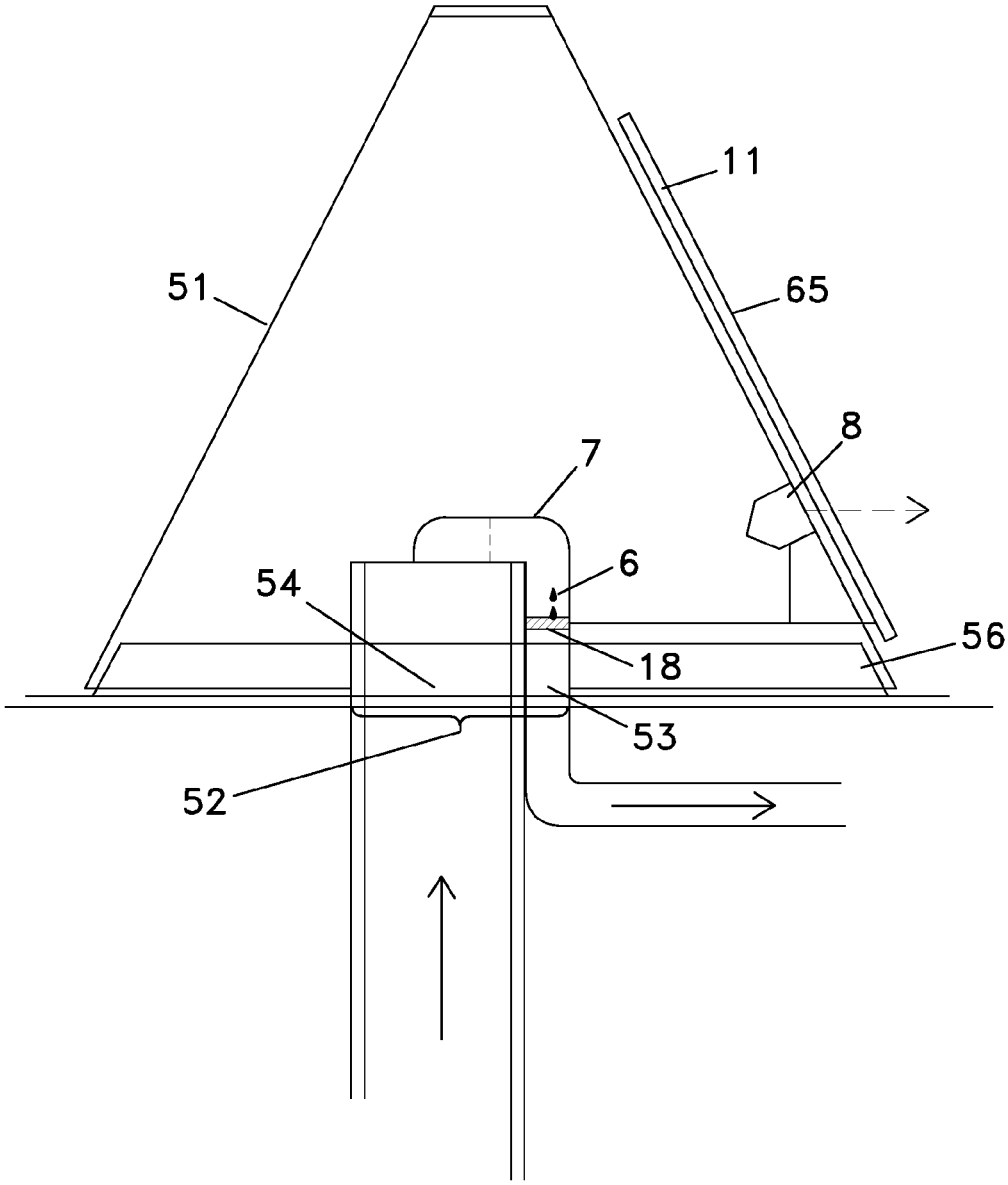
FIG. 18 shows a cut-away, cross-sectional view of an embodiment of the inventive technology.

As mentioned, the PLC may be a critical component of the inventive system in certain preferred embodiments. As shown in FIG. 10, it may comprise a leak data detector (Rd), a leak time recorder (Rt), a leak location recorder (Rl), and/or a recorder that records time of acknowledgement or receipt of notification by a human operator (Ra). Such capability could be, of course, easily programmed by one of ordinary skill in the art. The PLC typically will play a role in the automatic shutdown system (20) which, perhaps in the event of no human acknowledgement of receipt of notification of a leak, automatically shuts down the flow through the leaking conduit. In certain embodiments, there may be at least one additional programmable logic controller (21), and a PLC-to-PLC communication system (22) (e.g., fiber optic, Ethernet ethernet radio, 900 MHz radio, device net) configured to enable communication between the programmable logic controller and the at least one additional programmable logic controller. Such additional PLC may enhance operational response and data recordation, in addition to providing a redundancy beneficial in the event of PLC malfunction.

As mentioned, the communication system may interface into the PLC rack (via, e.g., an input card), and the PLC may be programmed to provide desired functionalities. In one of many examples, the output of the detector (information) is conveyed via a communication system and may be thereafter plumbed into a PLC digital input card. The PLC upon receiving input (whether it be such information of a modified version thereof), may activate a set of software commands to implement a human notification system and broadcast a message (a type of visual notifier) via network connection to a remote monitoring location as well as the local location. The PLC may also activate a visual alarm such as a flashing light (another type of visual notifier) and/or an audible notifier (a loud alarm sound) in the event of a leak and display on a screen in the header house which well has generated the condition (through use of the leak location recorder). Preferably, the PLC's are programmed to identify the source of the input (i.e., the location of the leak). Programming of the PLC may effect display of the location on digital signage and any display connected to the system either via network or hardwired (as is the case with a viewing panel). Proper identification of location of leaks may be achieved by, e.g., a unique identifier on wireless transponders (23) generating a leaked condition signal (information regarding the presence of a leak), a GPS system, or any unique location identifier that may form part of the information regarding the presence of a leak, conveyed by the communication system. The PLC response may be contingent on customer needs; in some cases a visual indication of problem may be sufficient, in other cases a system shutdown may be warranted. Indeed, such functionalities may be afforded by the PLC; the PLC, may be critical to the operation of the response system.

As mentioned, embodiments of the inventive technology may comprise a response system (10) coordinated with the programmable logic controller to automatically act in the even of detection of a well fluid leak. As mentioned, such response system may comprise a human notification system (which may, but need not, include a wireless communication system) that effects a sensible indication (e.g, a visual notifier and/or an audible notifier) in the event of a leak. The human notification system may also include a leak location identifier (such may be an important feature, of course, in allowing for leak mitigation such as quick repair and cleanup). It may include a wireless communication (23) system that is able to contact a human operator at a remote location (e.g., via cell phone, as where an operator is off-site). The response system may comprise an automatic shutdown system (20) which may, in certain embodiments, immediately shut off flow to a leaking conduit (regardless of any acknowledgement of notification of the leak by a human). In other embodiments, automatic shutdown (which typically indicates only an isolated shutdown of flow through the specific leaking conduit) may take place only after non-acknowledgement of receipt of notification by a human (this feature may be found in embodiments where the PLC is programmed to require leak notification receipt acknowledgement). A failure to respond within a certain number of requests or a specified period of time(s) may constitute a failure to acknowledge. Indeed, PLC's may be programmed to respond based on the response of the operator. In other words, in particular embodiments, if the operator on duty does not respond within a specified timeframe, a PLC may then instigate a shutdown of the mining unit while recording the time of the detected leak and the time of the response from an operator once the operator has responded to the alarm. Such programmed requirement may be autonomous leak notification receipt acknowledgement, or authorized leak notification receipt acknowledgement, as will be discussed further below.

Again, in order to provide a tracking mechanism for the end user, a PLC may include a programmed requirement of leak notification receipt acknowledgement (e.g, a requirement that an operator acknowledge receipt of alarm condition in the event of leak). As mentioned, this acknowledgement can be in two basic forms; autonomous and authorized. In other words, an autonomous acknowledgement can be initiated by any person while an authorized acknowledgement can be initiated only by authorized personnel. The autonomous acknowledgement can be achieved by any of a number of means including a simple 'on/off' switch. The output of this switch may be interfaced into the PLC to provide a means of recording the time at which the acknowledgement of notification was received (autonomous systems will not provide a means of recording who acknowledged the alarm). This function can also be software driven such that the acknowledgement can be driven from a display panel programmed with a 'switch' function. The authorized acknowledgement may be achieved by allowing only specific individuals to access the switch. This accessibility may be controlled by utilizing an electronic 'lock' switch. In certain embodiments, such electronic switch may be controllable only by a key encrypted into the same database as the electronic switch, which will disallow the use of any counterfeit or non-authorized keys to provide the acknowledgement function. The key and the electronic switch may retain information about by whom and when the acknowledgement was made. The key and the switch may provide an auditable function to cross-reference the acknowledgement record from the PLC to the user's key. The output of the switch may be directed into the PLC, which may then record the event and acknowledgement into memory and where possible report to remote operator station(s). This style of electronic switch and key may ensure accountability and disallow for autonomous alarm acknowledgement. A second level of recording and an increased level of accountability may be achieved by locating a second electronic switch at each wellhead and programming the PLC to disallow local acknowledging of the alarm until the wellhead electronic switch sends signal to the PLC notifying of wellhead acknowledgement. Exemplary key/switch may be manufactured by Videx under the CyberLock product name. Preferred embodiments may use the ES2, electronic switch and a CyberKey for the authorized acknowledgement function.

As mentioned, at least one power supply may power the at least one well fluid leak detector, the communication system, the PLC, and the response system. Indeed, there may be one power source for all the components, or one for each, or different components may share a power supply. Often, the detector and part of the communication system (e.g., the transmission radios) will share a power supply (e.g., a battery, or a solar source, wind power, as but three examples), and the other components will share a different power supply. As to specific power supply requirements, the leak detector may be 5VDC or 3.2VDC, the communication system may be 3.2 VDC (+0.1 to −0.7VDC) (3.2 VDC may be considered the lowest safe voltage in certain natural gas applications), the PLC may be powered by 110V AC or 24 VDC, and the response system may be powered by 24 VDC (or 3 VDC, 5 VDC, 12 VDC, 24 VDC, or 110 AC). Of course, such power supply specifications are merely exemplary (i.e., others can be used instead as the specific application may permit).

As mentioned, information may be conveyed by the communication system and received by the PLC (perhaps after transmission from a receiver that is part of the communication). Further, in some embodiments, a detector circuit board may act as an interface with the downstream end of the communication system so as to input information to the PLC (perhaps such detector circuit board will condition/organize such information for receipt by the PLC; regardless, the PLC acts according to such information). The information conveyed may be a simple digital (or analog) signal that is sent in the event of a leak, or it may be a digital (or analog) signal that is sent in the event of a non-leaking condition (such that absence of such signal indicates presence of a leak. Of course, the PLC would be programmed accordingly. It is of note that although a circuit board is not a required part of the inventive technology, the leak detector and the communication system (at least the wellhead located portion thereof) may share a circuit board (although indeed each could have their own circuit board).

Certain embodiments may include a strictly wired communication system. In such embodiments, and perhaps others, the at least one well fluid leak detector may be powered by a 5VDC power supply and the communication system may be powered by a 24 VDC power supply. In certain wired embodiments, the apparatus may involve conductors from the detectors (e.g., at each wellhead) to the PLC. The conductor may comprise eight individual conductors in a single sleeve (such as CAT5E cable). In such embodiments, four of the conductors may be utilized for the detector and four may be utilized for a functionality verification system (25). In particular embodiments, the entire eight conductors are terminated at the circuit end into an RJ45 plug, which may be the connection for an RJ45 socket dedicated to the detector.

However, given the numerous locations at which a leak is possible and to be quickly resolved, and the distance of wellheads from header houses in the U3O8 mining environment (the location of the wellheads can be more than eight hundred feet from PLC's located at the header house), wireless communication systems are more practical and less labor-intensive. Such communication systems may operate under the following protocols: RS232, RS422, RS485, 802-11, ethernet and zigbee; and according to the following methodologies: bluetooth, mesh, point to point and point to multi-point and ethernet. Functionality may be enhanced by use of at least one radio as a coordinator, and at least one (typically most or all as repeaters). Zigbee mesh is a very functional wireless architecture.

In certain embodiments of the mesh radio type system, each wellhead may have one of the child mesh radios coupled to the battery or solar power or combination of battery and solar power system and the leak detector. The combination of these individual components may provide a communication system which will convey information to the PLC(s) to provide for the communication of detected leaks and allow for subsequent action which may be necessary to mitigate the potential surface contamination by well fluid (e.g. U3O8 mining solution). In preferred embodiments, each wellhead mesh radio (a type of transponder, and part of the communication system) may also operate as a repeater (26) in addition to being the communicator for the detector to which it is attached. The repeater function will enhance the ability for other wellhead radios to ultimately reach the coordinator and/or PLC but will not detract from the main purpose of the radio as the communication channel from the detector to a PLC.

In the mesh radio embodiment, connectivity between PLC's responsible for each well field and each wellhead can be accomplished with radio or hardwire (PLC-to-PLC communication system). In other words, it may not be necessary to connect every PLC to a mesh radio if a connection exists between that PLC and a PLC which has a mesh radio connected to it. The connection between PLC's can be accomplished with fiber optic, Ethernet, Ethernet Radio, 900 MHz radio, device net, or other type of PLC to PLC communication system; it is not necessarily reliant upon mesh-to-mesh communication, but mesh communication can be used instead or additionally.

In particular embodiments, wireless communication systems can be configured to operate in the point to multi-point fashion. In such embodiments, the radio acts not only as an end-device bridge-to-PLC, but may also act as a repeater (26) providing a greater distance between the most remote locations and a PLC. Each radio may be connected to an end device and networked by addressing each individual radio to point at the parent or PLC radio where all data is ultimately destined (e.g., a coordinator). In some cases the individual radios may be too distant to reach the parent radio. In such cases, 'repeaters' may be necessary. These repeaters may be differentiated from other forms of repeaters insofar as they may also be connected to detectors and not only act as repeaters for distant radios which would not otherwise be able to reach the parent radio, but also as bridges to detectors. In particular embodiments, every radio is connected to a device and can also act as a repeater. There may be radios located at sites where there is no well conduit (they may be standing alone in the prairie), serving as repeaters. Conventional 'other forms of repeaters' may be found in configurations having a 'daisy chain' style of communication. If a link in the chain is lost, all data coming from that link is lost until the link is restored. This is the major downfall of such configurations.

Figure 5B:
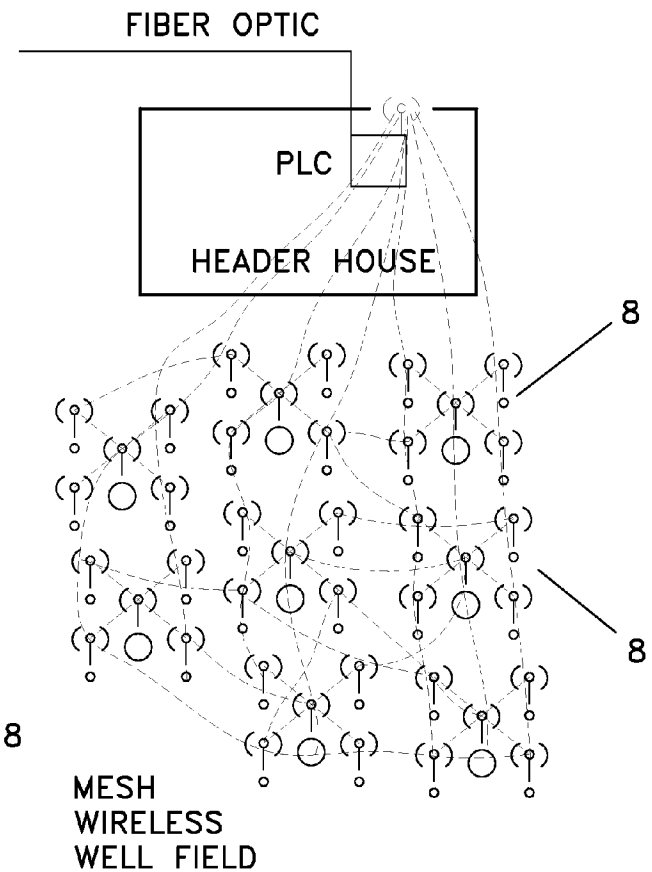
FIG. 5B shows a mesh communication system.
Figure 5A:
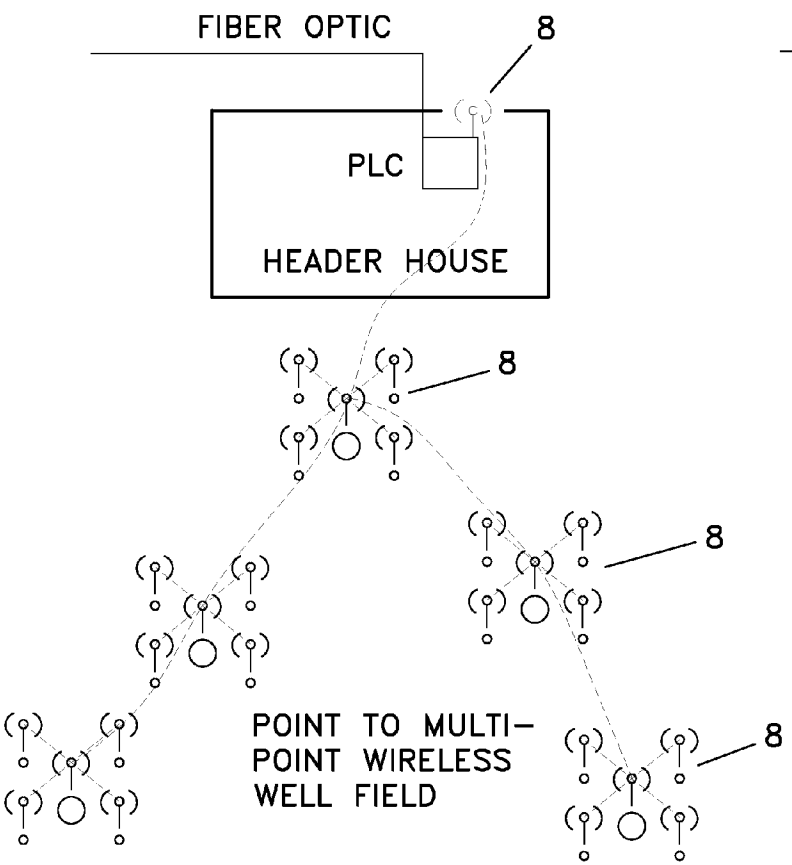

FIG. 5 shows a point-to-multi-point vs. mesh deployment for leak detection of U3O8 above ground wellheads. In the "PtMP" (point-to-multipoint) field, all radios may be connected to a detector and configured to talk to a 'coordinator' in the group, which may also be connected to a detector. The master/repeater (coordinator) may then send data to the next master/repeater (coordinator) in line to the final destination at the PLC radio. In this configuration, all radios which must communicate through a specific path are disabled if the path is disrupted at any downstream point on the daisy chain. The Mesh deployment differs in that though every radio is connected to a detector, they all talk to any radio within earshot. In other words, the data is not reliant on a single path and in the event of failure, and will 'self-heal' the path to the PLC to minimize lost data due to master/repeater failure. In such mesh system, typically the only loss of data is at the failed radio Particular embodiments of the inventive technology may include a functionality verification system, which itself may include a leak simulator (30). The leak simulator may be caused to automatically simulate a leak periodically (e.g., perhaps by the PLC, where the leak simulator may act on input conveyed by the communication system). The response system may further comprise a human notification system that effects a sensible indication in the event of system disfunctionality. The functionality verification system may also comprise a focused, communication system functionality validator (31) (which may only test the functionality of the radios and receivers of the wireless communication or of the wired communication system).

In particular embodiments of the wireless version of the system, the detector may be based on a 3VDC detection circuit (as but one example) and incorporate two relays to allow for the functional testing circuit. With an input from the radio, the testing/validation relay may be activated to close a circuit and thereby simulate a leak at the wellhead. Such testing may validate the probes and leads as a positive feedback signals the detector is functioning as designed, while no feedback signals a problem and will activate a fault alarm in the software. The alarm in the software is differentiated from a leak alarm and signals for maintenance to inspect the system and determine the source of fault at a specific location. The detector may be coupled to a relay in particular embodiments as well as a second relay for the functional testing aspect. Actuation of the circuit may trigger a high on the radio input and cause an alarm to be sequenced through radio transmission to the PLC.

Again, and as alluded to above, in particular embodiments, a second part of testing may reside in a focused, communication system functionality validator (31) (focused, because it may test only the functionality of the communication system). Knowing that each radio is functioning may be critical to knowing that the system is working correctly. This functional testing may be accomplished by monitoring each radio for periodic updates. If no update is received, the PLC may initiate a prompt for testing. Once an acknowledgement of the potential problem is received, the PLC may initiate a test sequence to the radio. A failure to respond within a certain number of requests or a specified period of time(s) may constitute a failure and trigger an alarm for system repair. This alarm will be different than the leak detected alarm and will not necessarily initiate a shutdown, but will persist until the problem has been addressed and the location returned to an online state.

Figure 6:
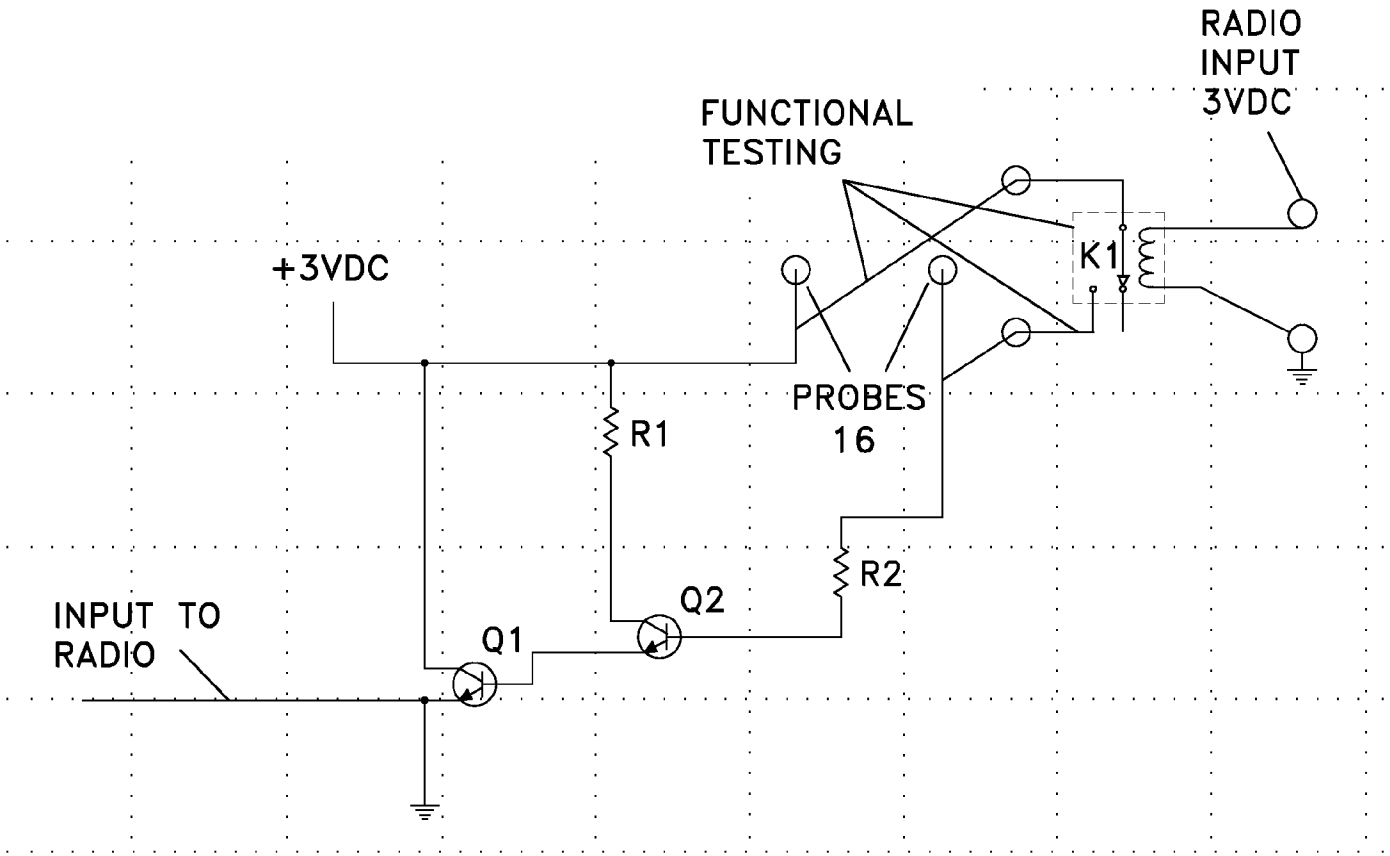
FIG. 6 shows an exemplary mesh radio circuit.
Figure 7:
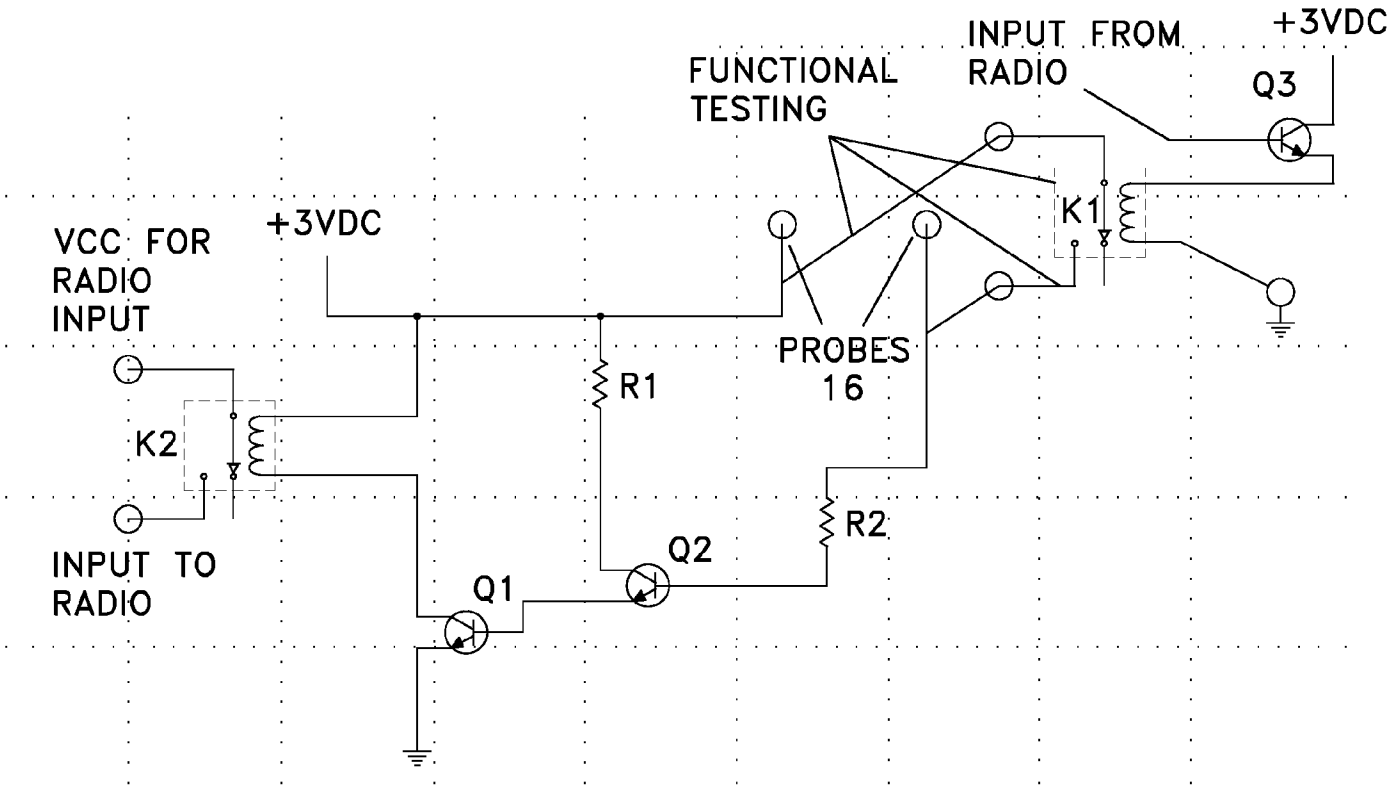
FIG. 7 shows an exemplary mesh radio circuit.
Figure 8A:
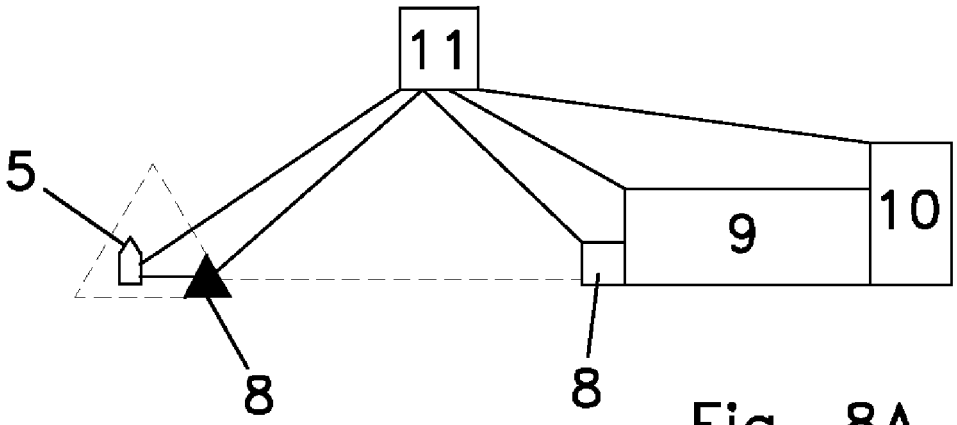
FIGS. 8A and 8B show sketches of possible embodiments of an wireless embodiment of the inventive technology. Dashed triangles show enclosures, which, depending on the application's geographic location, may be optional. Typically, however, such enclosures will be used.
Figure 8B:
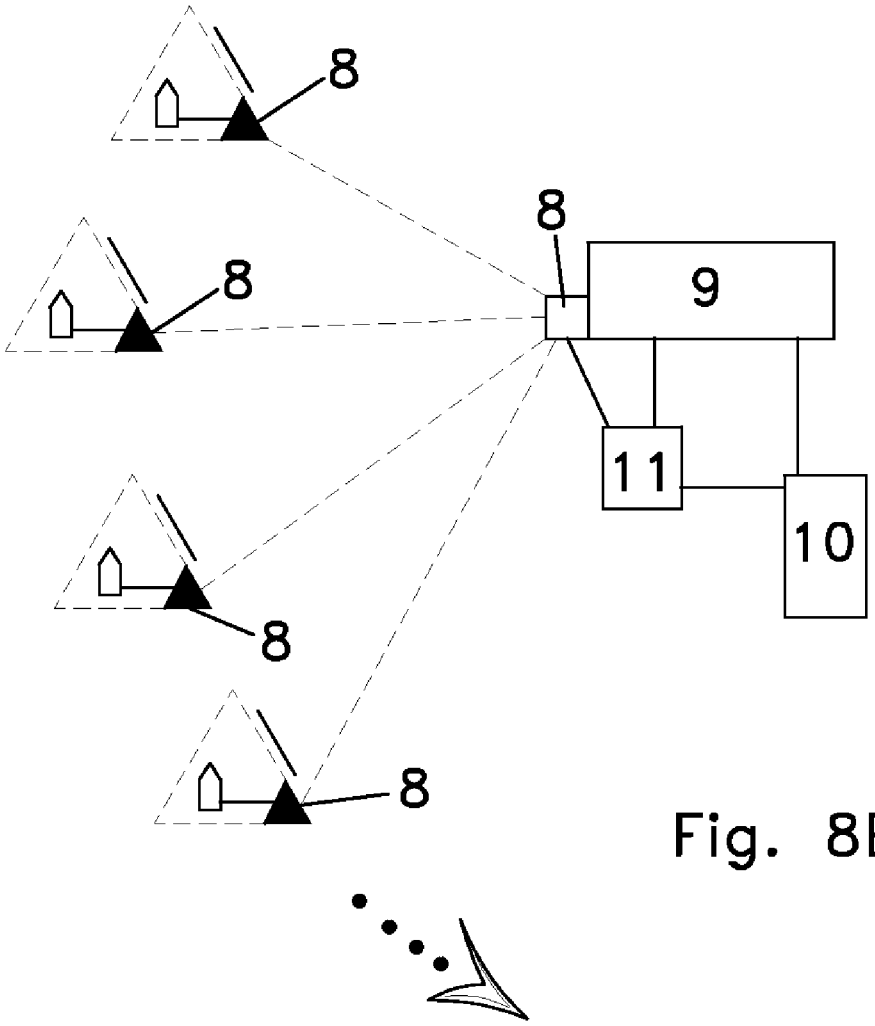
Figure 9:
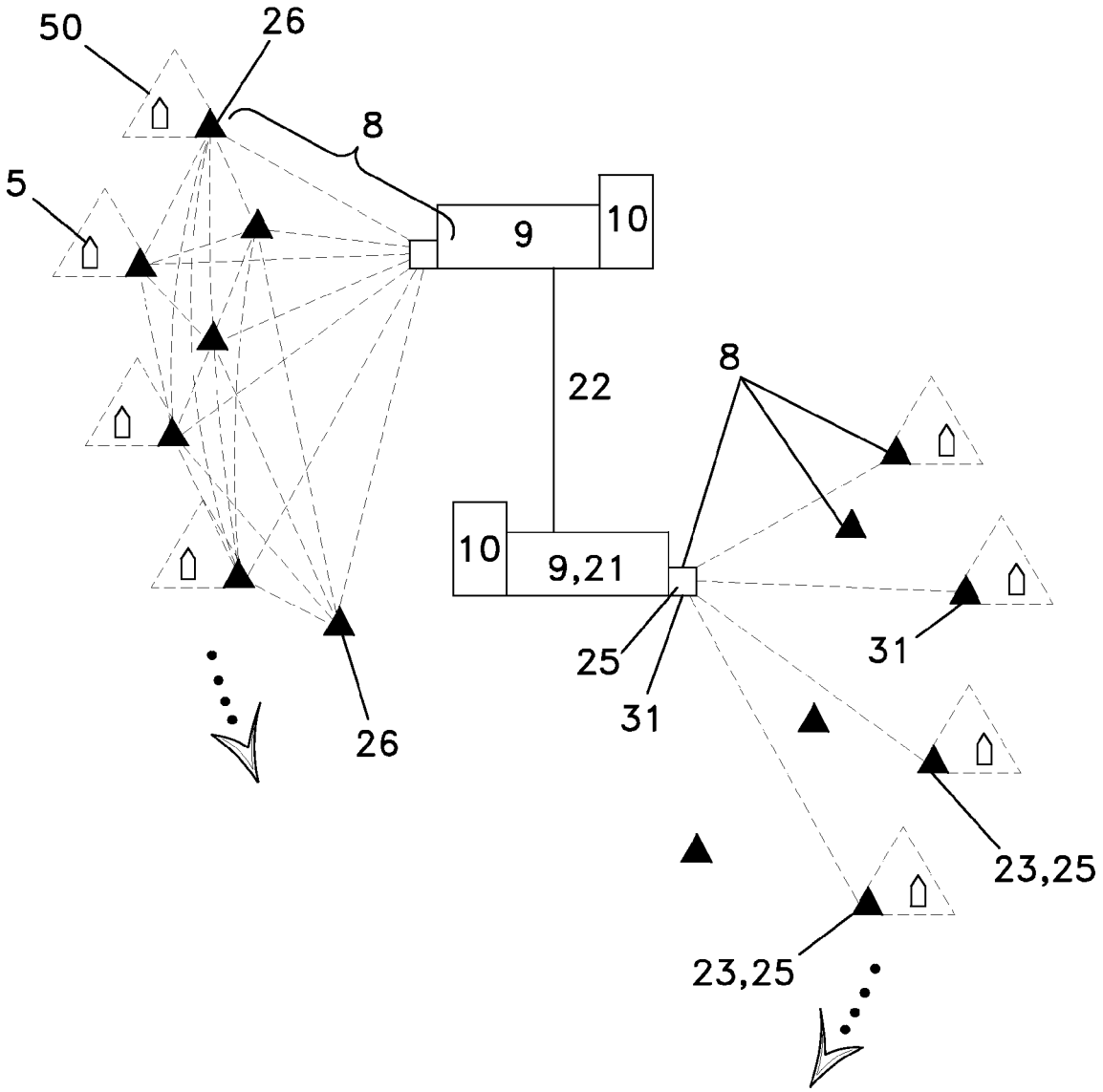
FIG. 9 shows a sketch of a wireless, mesh methodology-type, multiple PLC embodiment of the inventive technology. The right side of the figure does not show possible communication paths shown on the left, for clarity reasons. Note that in this figure, as in others, the power supply(ies) are not shown, also for clarity reasons.

As shown in FIGS. 6 and 7, which show slightly different mesh radio circuit embodiments, such circuit may relate to a method for circuit testing and validation through use of radio output to activate a relay and cause probes to indicate as if there were a leak. The function may be controlled by the PLC initiating the testing mode while disabling alarm mode. The test function can be built to individually test, e.g., the four inch and the one inch pipes at each wellhead or test them together. In such embodiment, the NO and CO pins of the relay(s) are paired with the probe leads and when activated by an output from the radio, close to simulate a leak.

A related method embodiment(s) may be described as a well fluid leak detection and response method that comprises the steps of establishing at least one well fluid leak detector to generate information regarding the presence of a leak of a well fluid from a well fluid conduit; conveying such information with a communication system; configuring (e.g., by programming and electrically connecting) a PLC to act according to such information; coordinating a response system with the PLC to automatically act in the event of detection of the well fluid leak; and powering the at least one well fluid leak detector, the communication system, the PLC and the response system. Other dependent steps of the method may correlate with the above-described apparatus type limitations and find support therein.

A related aspect of the inventive technology is what may be described as an environmental enclosure (50) for a well fluid conduit (7) (and for possibly a leak detector that is established to detect leaks from such conduit), where, typically, but for the enclosure, the well fluid conduit would be exposed the outdoor environment. In at least one embodiment, the enclosure comprises a structural (51) enclosure adapted to surround the well fluid conduit; at least one opening (52) through the at least one structural enclosure, the at least one opening sized to accommodate a well fluid entrance conduit (53) portion of the well fluid conduit and a well fluid exit conduit portion (54) of the well fluid conduit, wherein well fluid enters the environmental enclosure through the well fluid entrance conduit portion and exits the environmental enclosure through the well fluid exit conduit portion. In various embodiments, the environmental enclosure may further comprise one or more of the following: at least one sealer (55) that seals all spatial gaps at the at least one opening, a leaked fluid capture basin (56) established as a lower part of the at least one structural enclosure, an affirmatively thermally insulative (or insulated) environmental enclosure (such that it has an R factor of 5-8), and/or a structural enclosure that is aerodynamically streamlined relative to an anticipated horizontal wind. Affirmatively indicates that the design is selected/chosen to provide insulation (e.g., by, as but two examples, using known insulative materials such as certain insulating panels such as a polyisocyanurate or polystyrene panels, perhaps with structural panel support), instead of achieving some thermal insulation merely as an incident to blocking wind with a vertical barrel type enclosure. In preferred embodiments, the environmental enclosure is established substantially at a ground/atmosphere interface. In keeping with the labor reductive goal of certain embodiments of the inventive technology, preferred embodiments of the enclosure inventive technology do not penetrate into the ground whatsoever (but merely rest on the ground, thereby facilitating assembly). It is also of note that the structural enclosure adapted to surround the well fluid conduit surrounds it on all sides (top and bottom included), although a structural enclosure can still surround components and still have spatial gaps (60) where components (e.g., conduit) enter or exit the enclosure. When all spatial gaps are filled, the enclosure may be said to "comprehensively surround".

Particular embodiments of the inventive technology may be described as an environmental enclosure for a well fluid conduit that comprises a structural enclosure adapted to surround said well fluid conduit; and a vermin impenetrable floor (61) of said structural enclosure, wherein well fluid enters said environmental enclosure through said well fluid entrance conduit portion and exits said environmental enclosure through said well fluid exit conduit portion. The apparatus may further comprises at least one opening through said vermin impenetrable floor, said at least one opening sized to accommodate said well fluid entrance conduit portion and said well fluid exit conduit portion. In certain embodiments, the vermin impenetrable floor is a leaked fluid capture basin.

Figure 19:
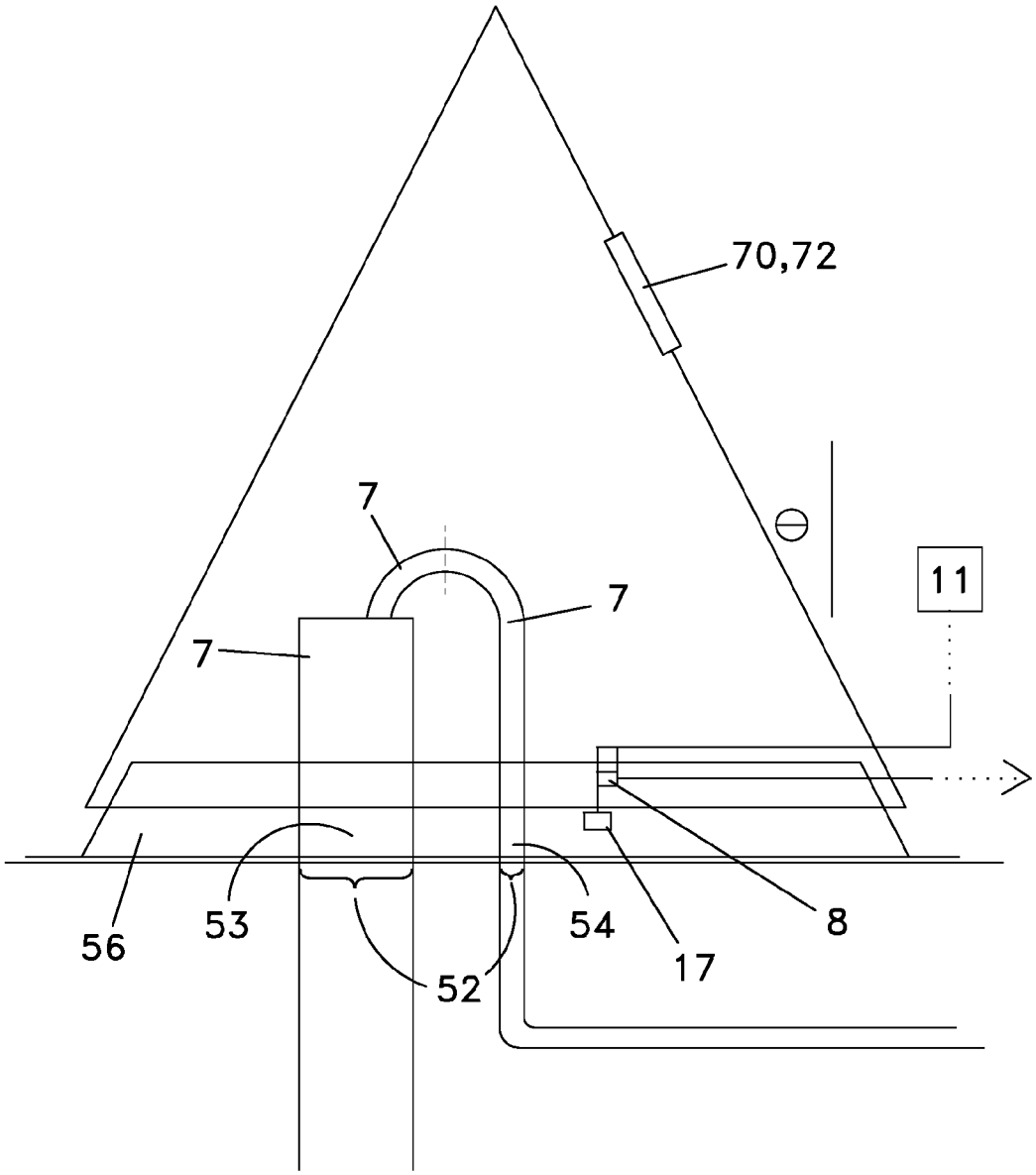
FIG. 19 shows a cut-away, cross-sectional view of an embodiment of the inventive technology.

In embodiments with sealer, the sealer may comprise cured foam (63) (e.g., EPF); instead, or in addition, it may comprise an elastic shroud (64) (e.g., rubber apron around a stub-out or conduit). Of course, other materials are possible. In embodiments where the structural enclosure is streamlined relative to an anticipated horizontal wind, the structural enclosure may be pyramidal in shape and/or the structural enclosure may comprise an exterior surface that is no less than 20 degrees relative to vertical (see angle theta of FIG. 19). Streamlined embodiments are actually forced against the ground during a wind, thereby enhancing immobility relative to the earth surface.

In embodiments with leaked fluid capture basins, such basins (through which at least one opening may be established for passage of conduit) may prevent (particularly when such openings are sealed) vermin and other undesirables from entering into the enclosure. Vermin, particularly those that evade capture by birds of prey, are a significant problem with prior art designs that have sides that are merely forced a few inches into the ground and do not provide a vermin impenetrable floor. In such prior art designs, vermin readily dig below the lower edge of the submerged sides and enter the enclosure. While in it, they take the opportunity to keep their teeth sharp by gnawing on enclosed components. The vermin-tight embodiments (e.g., as provided by the sealed opening and leaked fluid capture basin embodiments), provide the significant advantage of obviating such problems. Such basins also serve to capture leaked fluid and prevent it from contaminating the environment. Of course, the basins have limited capacity, and the leak must be stopped in a timely manner if all leaked fluid is to be captured and isolated from the environment.

The inventive enclosure technology may also have a broad application; indeed, the well fluid conduit surrounded by the structural enclosure may be barren lixiviant conduit (i.e., conduit such as piping that conveys barren lixiviant), lixiviant conduit, in-situ mining fluid conduit, in-situ leach mining fluid conduit, in-situ recovery mining fluid conduit, in-situ uranium mining fluid conduit, slurry mining fluid conduit, slurry uranium mining fluid conduit, well head, disposal well fluid conduit, uranium mining disposal well fluid conduit, production well fluid conduit, uranium mining production well fluid conduit, injection well fluid conduit, uranium mining injection well fluid conduit, hydrocarbon mining fluid conduit, water conduit, hot mineralized water conduit, hydrocarbon leach mining fluid conduit, oil well fluid conduit, oil conduit, natural gas mining fluid conduit, or natural gas conduit.

As mentioned, the environmental enclosure may be for the well fluid conduit and at least one well fluid leak detector. Indeed, it may be combined with aforementioned embodiments of the inventive leak detection and response technology. In such embodiments, the structural enclosure may be adapted to surround the well fluid conduit and the at least one well fluid leak detector. Particularly in such embodiments, the power supply for the detector (and/or part of the communication system) may be a solar panel (65) that is established externally of the environmental enclosure and configured to provide power to the at least one well fluid leak detector. It is of note that certain embodiments may involve at least one water sealing jacket that is established around the at least one leak detector.

It is also of note that either the well fluid entrance conduit portion of the well fluid conduit or the well fluid exit conduit portion of the well fluid conduit comprises a well casing portion (67) (in the case of in-situ leach mining, depending on whether the well is an injection well or a production well). In particular embodiments, there may be a visual inspection opening (70) allowing visual inspection of enclosed components, wherein the visual inspection opening may be filled by a removable opening filler (71) (e.g, a fiberglass, plastic or other material "cork" that may snugly fill the opening) to enable the visual inspection. Of course, the visual inspection opening may be covered with a window (72).

It is also of note that particular embodiments of the inventive technology may be described as comprising a structural enclosure adapted to surround the well fluid conduit; at least one opening through the at least one structural enclosure, the at least one opening sized to accommodate a well fluid entrance conduit portion of the well fluid conduit and a well fluid exit conduit portion of the well fluid conduit, wherein well fluid enters the environmental enclosure through the well fluid entrance conduit portion and exits the environmental enclosure through the well fluid exit conduit portion, and wherein the environmental enclosure is vermin tight (i.e., vermin cannot enter, although insects such as spiders, which do little damage, may). Such vermin tight embodiment may be accomplished merely by providing a floor as part of the structural enclosure, where that floor has openings that are sized such that, even where they are not sealed, are close enough in size to the pipe that passes therethrough so that vermin are excluded. Of course, a sealer may seal that hole (by sealing spatial gaps between the conduit and the edges of the opening) to assure that vermin are excluded and to expand the size of pipe on which the structural enclosure can be used.

It is of note that, particularly with regard to the aerodynamically streamlined embodiments (e.g., conical or pyramidal), the sides may have a 20 degrees from vertical angle (for WY, USA latitude, 27 degrees may be ideal for solar panel tilt, but such angle may result in an enclosure that has too large a base). It is of note that the streamlined enclosure may mitigate earth scour also, in that it may obviate the turbulence at the enclosure base that is caused by the vertical sides of prior art designs. Also, as mentioned, streamlined embodiments are forced against the ground during a wind, thereby enhancing their immobility. Aerodynamically streamlined does not mean that drag is minimized, but merely that vertical sides that may be characteristic of prior art designs are eliminated. In preferred embodiments, it may mean an at least 15 degree angle with vertical (with 20 degrees preferred in certain embodiments).

Additionally, the enclosure may be made primarily of foam, lined with polyurethane coating (as one example of many possible manufacturing materials that may be used). Further, the sealers may be created using reactive injection molding instead of high pressure injection. Regardless, in addition to excluding wind, rain, snow, blowing matter and vermin, and providing thermal insulation, the enclosure may help to keep sodium bicarbonate off the leak detectors, thereby avoiding the problems (probe fouling, compromise of detector function) caused by such salt. It is also of note that thermal insulation, which may be accomplished through the use of insulating panels (as but one example), perhaps lined with polyurethane coating, and sealed as indicated, may effect a temperature difference of at least 5 degs F, at least 10 degs F, at least 15 degs F, and/or at least 20 degs F. In one embodiment, where it is 32 degs F outside, it may be 46 degs F inside the enclosure. Not only does such insulation mitigate thermal cycling (and its deleterious effects on the conduit structure), but it also mitigates salt buildup.

Installing the enclosure may be relatively simple. First, a floor (e.g., a leaked fluid capture basin) with openings therein may be lowered onto the conduits at the site where they emerge from the ground. Sealant, if desired, may then by used to seal the spatial gap at the openings and around the conduit. The lateral sides (e.g., pyramid sides, which may weigh 12 lbs. in one embodiment) of the enclosure may then be lowered onto the floor (which may have raised sides that are sized to correspond to the lower opening of the lateral sides of the enclosure). In certain applications (e.g., a production monitor well), there may be at least one opening for 3 conduits. Upon installation, particular embodiments of the enclosure will exclude wind, rain, snow, blowing matter and vermin (e.g., rodent), in addition to mitigating salt buildup and/or providing thermal insulation.

As can be easily understood from the foregoing, the basic concepts of the present invention may be embodied in a variety of ways. It involves both leak detection communication and response techniques as well as devices to accomplish the appropriate communication and response. In this application, the various leak detection communication and response techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "detector" should be understood to encompass disclosure of the act of "detecting"—whether explicitly discussed or not—and, conversely, were there effectively disclosure of the act of "detecting", such a disclosure should be understood to encompass disclosure of a "detector" and even a "means for detecting" Such changes and alternative terms are to be understood to be explicitly included in the description.

Any acts of law, statutes, regulations, or rules mentioned in this application for patent; or patents, publications, or other references mentioned in this application for patent are hereby incorporated by reference. Any priority case(s) claimed by this application is hereby appended and hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i) each of the leak detection communication and response devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, xii) each potentially dependent claim or concept as a dependency on each and every one of the independent claims or concepts presented, and xiii) all inventions described herein.

In addition and as to computer aspects and each aspect amenable to programming or other electronic automation, the applicant(s) should be understood to have support to claim and make a statement of invention to at least: xvi) processes performed with the aid of or on a computer as described throughout the above discussion, xv) a programmable apparatus as described throughout the above discussion, xvi) a computer readable memory encoded with data to direct a computer comprising means or elements which function as described throughout the above discussion, xvii) a computer configured as herein disclosed and described, xviii) individual or combined subroutines and programs as herein disclosed and described, xix) the related methods disclosed and described, xx) similar, equivalent, and even implicit variations of each of these systems and methods, xxi) those alternative designs which accomplish each of the functions shown as are disclosed and described, xxii) those alternative designs and methods which accomplish each of the functions shown as are implicit to accomplish that which is disclosed and described, xxiii) each feature, component, and step shown as separate and independent inventions, and xxiv) the various combinations and permutations of each of the above.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in Hakim v. Cannon Avent Group, PLC, 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. An environmental enclosure for a wellhead fluid conduit comprising:

a structural enclosure adapted to surround said wellhead fluid conduit:

at least one opening through said at least one structural enclosure, said at least one opening sized to accommodate a wellhead fluid entrance conduit portion of said wellhead fluid conduit and a wellhead fluid exit conduit portion of said wellhead fluid conduit;

a leaked fluid capture basin established as a lower part of said at least one structural enclosure, at least one sealer that seals all spatial gaps around said wellhead fluid entrance conduit portion and said wellhead fluid exit conduit portion at said at least one opening;

a visual inspection opening allowing visual inspection of enclosed components, wherein said visual inspection opening is filled by an opening filler that is removable to enable said visual inspection; and a wellhead fluid leak detector established within said environmental enclosure;

wherein, but for said environmental enclosure, said wellhead would be exposed to an atmospheric environment, wherein well fluid enters said environmental enclosure through said wellhead fluid entrance conduit portion and exits said environmental enclosure through said wellhead fluid exit conduit portion, wherein a portion of said environmental enclosure abuts a ground surface underlying said environmental enclosure, wherein said environmental enclosure is affirmatively thermally insulative so as to have a R factor of at least five, wherein said wellhead fluid conduit comprises conduit selected from the group consisting of barren lixiviant conduit and lixiviant conduit, and wherein said environmental enclosure is vermin tight.

2. An environmental enclosure for a wellhead fluid conduit as described in claim 1 wherein said at least one sealer comprises cured expanded polystyrene foam.

3. An environmental enclosure for a wellhead fluid conduit as described in claim 1 wherein said at least one sealer comprises an elastic shroud.

4. An environmental enclosure for a wellhead fluid conduit as described in claim 1 further comprising a wellhead fluid leak notification system that automatically generates information in the event of detection of a well head fluid leak by said wellhead fluid leak detector.

5. An environmental enclosure for a wellhead fluid conduit as described in claim 4 wherein said notification system effects a sensible indication in the event of detection of a wellhead fluid leak by said wellhead fluid leak detector.

6. An environmental enclosure for a wellhead fluid conduit as described in claim 4 wherein said information facilitates an identification of the wellhead location of said wellhead fluid leak.

7. An environmental enclosure for a wellhead fluid conduit as described in claim 1 further comprising a coating that lines said environmental enclosure.

8. An environmental enclosure for a wellhead fluid conduit comprising:

a structural enclosure adapted to surround said wellhead fluid conduit and at least one wellhead fluid leak detector; and a vermin impenetrable floor of said structural enclosure, at least one opening through said vermin impenetrable floor, said at least one opening sized to accommodate said wellhead fluid entrance conduit portion and said wellhead fluid exit conduit portion;

at least one sealer that seals all spatial gaps at said at least one opening;

a wellhead fluid leak notification system that effects a sensible indication in the event of detection of a wellhead fluid leak by said wellhead fluid leak detector and that automatically generates information in the event of said detection, wherein said information facilitates an identification of the wellhead location of said wellhead fluid leak;

a visual inspection opening that allows visual inspection of enclosed components, wherein said visual inspection opening is filled by a opening filler that is removable to enable said visual inspection; and a leaked fluid capture basin established towards a lower portion of said structural enclosure, wherein, but for said environmental enclosure, said wellhead would be exposed to an atmospheric environment, wherein wellhead fluid enters said environmental enclosure through said wellhead fluid entrance conduit portion and exits said environmental enclosure through said wellhead fluid exit conduit portion.

wherein said environmental enclosure is affirmatively thermally insulative and has an R factor of at least five, wherein a lower portion of said environmental enclosure is established substantially at a ground atmosphere interface and said structural enclosure does not penetrate into ground below, and wherein said wellhead fluid conduit comprises conduit selected from the group consisting of barren lixiviant conduit and lixiviant conduit.

9. An environmental enclosure for a wellhead fluid conduit as described in claim 8 wherein said at least one sealer comprises cured expanded polystyrene foam.

10. (canceled; currently amended) An environmental enclosure for a wellhead fluid conduit as described in claim 8 wherein said at least one sealer comprises an elastic shroud.

11. An environmental enclosure for a wellhead fluid conduit as described in claim 8 wherein said structural enclosure is streamlined relative to an anticipated horizontal wind.

12. An environmental enclosure for a wellhead fluid conduit as described in claim 8 wherein said at least one structural enclosure is pyramidal in shape.

13. An environmental enclosure for a wellhead fluid conduit as described in claim 8 further comprising a solar panel established externally of said environmental enclosure and configured to provide power to said at least one wellhead fluid leak detector.

14. An environmental enclosure for a wellhead fluid conduit as described in claim 8 further comprising at least one water sealing jacket established around said at least one leak detector.

15. An environmental enclosure for a wellhead fluid conduit as described in claim 8 wherein either said wellhead fluid entrance conduit portion of said wellhead fluid conduit or said wellhead fluid exit conduit portion of said wellhead fluid conduit comprises a well casing portion.

16. An environmental enclosure for a wellhead fluid conduit as described in claim 8 wherein said removable opening filler comprises a cork.

17. An environmental enclosure for a wellhead fluid conduit as described in claim 8 wherein said environmental enclosure is vermin tight.

18. An environmental enclosure for a wellhead fluid conduit as described in claim 8 further comprising a coating that lines said environmental enclosure.

19. An environmental enclosure for a wellhead fluid conduit as described in claim 8 wherein said vermin impenetrable floor forms at least a part of said leaked fluid capture basin.

* * * * *